US008968080B1

(12) United States Patent
Anderson et al.

(10) Patent No.: US 8,968,080 B1
(45) Date of Patent: Mar. 3, 2015

(54) DISPLAY OF THIRD PARTY CONTENT ON A WAGERING GAME MACHINE

(75) Inventors: Peter R. Anderson, Glenview, IL (US); Bruce H. Blair, Oak Park, IL (US); John M. Burica, Hometown, IL (US); Mark B. Gagner, West Chicago, IL (US); Vernon W. Hamlin, Lisle, IL (US); Michael J. Irby, Chicago, IL (US); Timothy C. Loose, Chicago, IL (US); Scott M. Minch, Wheeling, IL (US); Mark C. Pace, Palatine, IL (US); Eugene M. Rigsby, Libertyville, IL (US); Craig J. Sylla, Round Lake, IL (US); Alfred Thomas, Las Vegas, NV (US)

(73) Assignee: WMS Gaming, Inc., Waukegan, IL (US)

( * ) Notice: Subject to any disclaimer, the term of this patent is extended or adjusted under 35 U.S.C. 154(b) by 189 days.

(21) Appl. No.: 13/289,549

(22) Filed: Nov. 4, 2011

Related U.S. Application Data

(60) Provisional application No. 61/410,724, filed on Nov. 5, 2010.

(51) Int. Cl.
*A63F 9/00* (2006.01)

(52) U.S. Cl.
USPC ..... 463/25

(58) Field of Classification Search
None
See application file for complete search history.

(56) References Cited

U.S. PATENT DOCUMENTS 4,562,467 A * 12/1985 Bradley ..... 375/240.12
5,923,786 A * 7/1999 Murayama ..... 382/242
6,295,376 B1 * 9/2001 Nakaya ..... 382/236
6,308,327 B1 * 10/2001 Liu et al. ..... 725/37
6,466,209 B1 * 10/2002 Bantum ..... 345/589
7,444,659 B2 * 10/2008 Lemmons ..... 725/34
7,747,087 B2 * 6/2010 Laude et al. ..... 382/232
7,779,438 B2 * 8/2010 Davies ..... 725/32
8,068,544 B2 * 11/2011 Roman ..... 375/240.17
8,079,054 B1 * 12/2011 Dhawan et al. ..... 725/105
8,109,829 B1 * 2/2012 Morgan et al. ..... 463/29
8,270,487 B1 * 9/2012 Kizhepat et al. ..... 375/240.12
8,376,845 B2 * 2/2013 Cockerille et al. ..... 463/30
8,392,507 B2 * 3/2013 Ramos et al. ..... 709/205
2001/0024525 A1 9/2001 Hata et al.
2001/0031089 A1 10/2001 Hata et al.
2001/0051005 A1 12/2001 Itagaki et al.
2002/0031276 A1 3/2002 Yagishita et al.
2002/0037081 A1 * 3/2002 Rogoff et al. ..... 380/278
2002/0059590 A1 * 5/2002 Kitsukawa et al. ..... 725/36
2002/0164076 A1 11/2002 Pasquier
2003/0005285 A1 * 1/2003 Graunke ..... 713/153
2003/0028873 A1 * 2/2003 Lemmons ..... 725/36
2003/0056103 A1 * 3/2003 Levy et al. ..... 713/176

(Continued)

*Primary Examiner* — Seng H Lim
(74) *Attorney, Agent, or Firm* — DeLizio Gilliam, PLLC

(57) ABSTRACT

In some embodiments, a computerized method includes: creating a number of frames of images for displaying on a monitor of a wagering game machine; and selecting at least a subset of the number of frames. The method can also include performing pixel encoding in the images of the subset of the number of frames, where the pixel encoding is used to identify at least one of adding third party content to the images. The method can also include replacing the images with the third party content, where the adding of the third party content and replacing with the third party content occurs after creating the frame but prior to the displaying the frame on the monitor of the wagering game machine. The method can also include transmitting the number of frames of images to the monitor of the wagering game machine.

17 Claims, 16 Drawing Sheets

(56) References Cited

U.S. PATENT DOCUMENTS

| | | | | |
|---|---|---|---|---|
| 2003/0056104 | A1* | 3/2003 | Carr et al. | 713/176 |
| 2003/0086621 | A1 | 5/2003 | Hata et al. | |
| 2004/0062305 | A1 | 4/2004 | Dambrackas | |
| 2004/0151389 | A1 | 8/2004 | Itagaki et al. | |
| 2005/0069034 | A1 | 3/2005 | Dambrackas | |
| 2005/0072846 | A1* | 4/2005 | Lubow | 235/462.01 |
| 2005/0243920 | A1 | 11/2005 | Murakami et al. | |
| 2006/0126720 | A1 | 6/2006 | Dambrackas | |
| 2006/0126721 | A1 | 6/2006 | Dambrackas | |
| 2006/0262982 | A1 | 11/2006 | Matsumoto et al. | |
| 2007/0076967 | A1 | 4/2007 | Kim et al. | |
| 2008/0107169 | A1* | 5/2008 | Roman | 375/240 |
| 2008/0107174 | A1* | 5/2008 | Roman | 375/240.02 |
| 2008/0268961 | A1* | 10/2008 | Brook et al. | 463/42 |
| 2009/0129755 | A1* | 5/2009 | Rakib et al. | 386/124 |
| 2009/0327856 | A1* | 12/2009 | Mouilleseaux et al. | 715/230 |
| 2010/0048299 | A1* | 2/2010 | Guthrie et al. | 463/31 |
| 2010/0111182 | A1* | 5/2010 | Karczewicz et al. | 375/240.16 |
| 2010/0118943 | A1 | 5/2010 | Shiodera et al. | |
| 2010/0220936 | A1 | 9/2010 | Yamaguchi et al. | |
| 2010/0232720 | A1 | 9/2010 | Tsai et al. | |
| 2011/0019005 | A1* | 1/2011 | Ramos et al. | 348/181 |
| 2012/0071237 | A1* | 3/2012 | Cockerille et al. | 463/30 |
| 2012/0100915 | A1* | 4/2012 | Margalit et al. | 463/31 |

* cited by examiner

DISPLAY OF THIRD PARTY CONTENT ON A WAGERING GAME MACHINE

RELATED APPLICATIONS

This application claims the priority benefit of U.S. Provisional Application Ser. No. 61/410,724 filed Nov. 5, 2010.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, and more particularly to wagering game systems including display of third party content on a wagering game machine.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Figure 1:
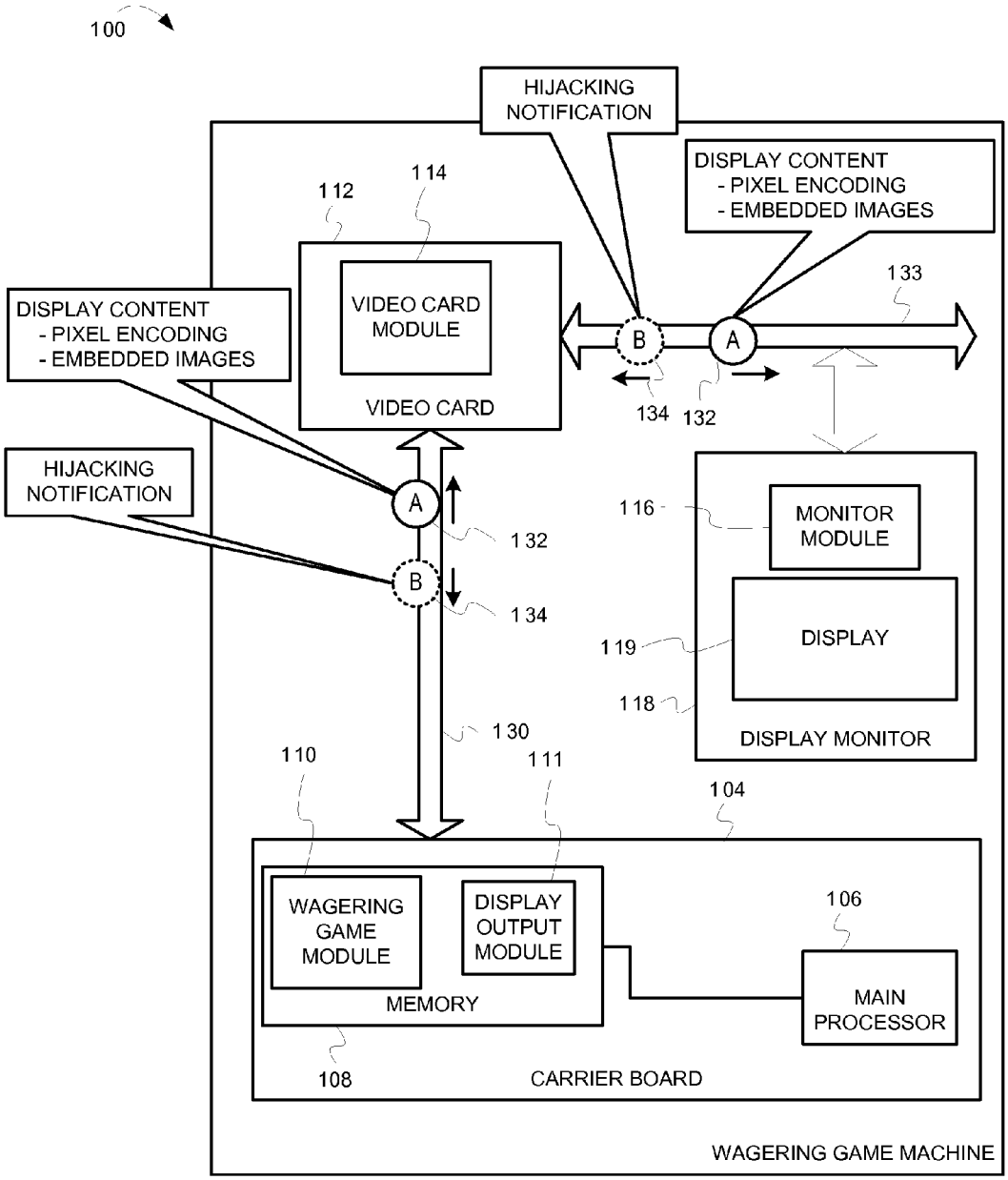
FIG. 1 is a wagering game machine architecture for monitoring display of third party content, according to some example embodiments.

This description of the embodiments is divided into six sections. The first section provides an introduction to some example embodiments, while the second section describes an example of selected components of wagering game architecture. The third section describes example operations performed by some embodiments and the fourth section describes another example wagering game architecture. The fifth section describes an example wagering game machine in more detail. The sixth section presents some general comments.

Introduction

This section provides an introduction to some example embodiments. Some example embodiments monitor and govern the display of unauthorized and/or authorized third party content on a wagering game machine. Some example embodiments preclude or at least hinder the display of unauthorized third party content on a wagering game machine. Some other example embodiments monitor and authenticate authorized third party content to allow such content on displays of a wagering game machine In some situations, third parties are hijacking one or more displays of a wagering game machine to display their own content. For example, a third party may want to replace an image being displayed on one of the displays with advertising content. Accordingly, the third party may attempt to replace or include their content on one of the displays of the wagering game machine. The displays that are being hijacked may or may not be displaying content that is relevant to actual wagering game play.

For example, third parties may convince operators of wagering game establishments to allow their third party content (e.g., advertising content) to be added to one or more displays of the wagering game machines. The operators of the wagering game establishment may only allow third party content on secondary displays of the machines because such displays typically do not include actual wagering game play. However, in some configurations, secondary displays of the wagering game machine can be displaying bonus content that is relevant to actual wagering game play. Alternatively, these second displays can be displaying data regarding the theme, the jackpot amount, various winning levels and combinations, etc.

In some situations, instead of replacing content, a third party may add their content to an existing image on a display of the wagering game machine. Accordingly, the original display content of the wagering game machine is squeezed, distorted, etc. In exchange for allowing such access, the operators of the wagering game establishments can be compensated by third parties. The operators can therefore allow third parties access to the internal hardware of the wagering game machine. The third parties can insert their own hardware (e.g., video mixer) in the wagering game machine. The third parties can install their hardware at different points between the main processor (that creates the video frames for display) and the display monitors. For example, the third parties can install their hardware between the video card and the display monitor. During operation, this third party hardware intercepts display content and processes (e.g., replaces, alters, etc.) the display content. The third party hardware then forwards these processed display content to the display monitor for display. As noted above, this hardware can replace original display content with their own display content (e.g., advertising), add their own display content by altering or squeezing down the original display content, etc.

Even if the original display content remains after alteration by the third party hardware; the fonts, numbers, graphics, etc. of the original display content may be distorted to a point of being unreadable. This alteration of the original content can be even more problematic for touch screen displays. In particular, the third party hardware can alter the content of the touch screen display to a point where button selection locations on the touch screen are moved too far from their original locations. This is particularly problematic for experienced players who assume that touch screen buttons will be in the same location for a given wagering game machine. In particular, an experienced player can select the wrong button because they are selecting buttons based on where the buttons were originally located on the display monitor. Specifically, an experienced player can be viewing the game play and not the display of button locations (assuming that the button locations will remain constant).

Also of particularly concern is the lack of control over what display content is being displayed by the third party hardware. For example, the third party hardware could alter the content regarding the jackpot amount or various winning combinations for the wagering game machine. Accordingly, the altered content may misrepresent the amount of the jackpot or various winning combinations. For example, the original display content on a secondary display can indicate that the jackpot is $50,000. However, the display content can be altered or distorted to a level that the amount of the jackpot appears to be a much larger amount (e.g., $150,000). Accordingly, the operators can be liable for additional monies when a player wins the jackpot for this wagering game machine because of the distortions of the display content caused by the third party hardware.

Additionally, altering or replacing original content can destroy the look-and-feel of the wagering game machine. Altering or replacing original content can also affect the immersive game play psychology. In particular, game play of a player can be affected by what is shown on the displays of the wagering game machine. For example, a player may not play a wagering game machine if they do not like the third party advertising being displayed thereon. To illustrate, a player may not want to play a wagering game machine having a family friendly theme (e.g., Wizard of Oz) if the third party content is advertising for a hard liquor.

The display or display monitor as defined herein can include a display for images or video, touch screens, mirrors, etc. The display for images or video can include images or video for wagering game play and non-wagering game play. An example of a video or image of non-wagering game play can comprise an image or video that identifies the theme of a wagering game machine. This is in contrast to a display of the wagering game play itself (e.g., the reels for a video slot machine, cards of video poker, etc.). The term "display content" as defined herein can include any image or video being displayed on one of the displays of a wagering game machine.

Operating Environment

This section describes an example operating environment and presents structural aspects of some embodiments. This section includes discussion about of a part of a wagering game machine architecture and a display monitor for a wagering game machine.

FIG. 1 is a wagering game machine architecture for monitoring display of third party content, according to some example embodiments. FIG. 1 illustrates parts of a wagering game machine 100 that are relevant for monitoring display of third party content. The wagering game machine 100 includes a carrier board 104. The carrier board 104 is also known as a motherboard, system printed circuit board, baseboard, main board, etc. A main processor 106 and a memory 108 are located on the carrier board 104. The main processor 106 can be any suitable processor, such as an Intel® Core™ i3 processor, an Intel® Core™ i5 processor, an Intel® Core™ i7 processor, an Intel® Pentium processor, Intel® Core 2 Duo processor, AMD Opteron™ processor, or UltraSPARC processor. The memory 108 can be representative of a volatile and/or nonvolatile machine-readable storage medium. The main processor 106 and the memory 108 are communicatively coupled together. The memory 108 is configured to store a wagering game module 110 and the display output module 111. The wagering game module 110 and the display output module 111 can be software or firmware that is loaded into the main processor 106 for execution during different times when the wagering game machine 100 is operational. For example, during wagering game play, the main processor 106 loads the wagering game module 110 for execution to generate results of the wagering game play.

The main processor 106 also loads the display output module 111 for execution to generate display content (e.g., video, images, etc.) for display on one or more display monitors of the wagering game machine 100. In this example, the wagering game machine 100 includes one display monitor (a display monitor 118). In some applications, the wagering game machine 100 can comprise multiple display monitors. For example, a main display monitor can display the actual wagering game play. A secondary display monitor can display a theme, jackpot amounts, bonus content, progressive jackpot gaming content, etc. A touch screen or display buttons are another type of display monitor, where content can be displayed. The players can select the touch screens or display buttons as inputs as part of the wagering game play. Accordingly, the display output module 111 can generate display content for display to any or all of these types of display monitors.

The wagering game machine 100 also includes a video card 112 that is communicatively coupled to the carrier board 104 through a bus 130. In some example embodiments, the bus 130 comprises a Peripheral Component Interconnection (PCI) bus. The video card 112 includes a video card module 114 for processing of video, images, etc. received from the execution of the display output module 111. The video card module 114 processes the video, images, etc. for display on the display monitor 118. The video card module 114 can be hardware, software, firmware or a combination thereof.

The wagering game machine 100 includes a display monitor 118 having a display 119 and a monitor module 116. The monitor module 116 is communicatively coupled to the video card module 114 through a cable 133. In some example embodiments, the cable 133 comprises a High Definition Multimedia Interface (HDMI) interface or a Digital Visual Interface (DVI) interface. In some other example embodiments, the cable 133 can be a Video Graphics Array (VGA) cable, a coaxial cable, composite video cable, component video cable, Separate Video (S-Video) cable, etc.

In some example embodiments, the cable 133 is an armored cable. Also, the cable 133 can be coupled to the video card 112 and the display monitor 118 using an epoxy or some other type of adhesive. Such a configuration can preclude a third party from easily removing the cable 133 and placing hardware and additional cables there between. For example, a third party may attempt to add new hardware and a T cable configuration for coupling the video card 112 to the new hardware that is then coupled to the display monitor 118. As described herein, this new hardware can replace or alter the display content that is transmitted from the display output module 111 to the monitor module 116 through the video card 112.

The monitor module 116 also processes the video, images, etc. prior to display on the display monitor 118. For example, the monitor module 116 can process the data based on specific manufacturing standards or requirements for the display monitor 118 (e.g., a resolution level, refresh rate, etc.).

FIG. 1 also shows messaging between the different components along the bus 130 and the cable 133, which can occur when display content is being displayed on the display monitor 118. As further described below, the display output module 111 can create display content 132 that includes a pixel encoding, embedded images and/or challenge-response authentication. The monitor module 116 receives the display content 132 from the display output module 111 through the video card module 114. The pixel encoding, embedded images and/or challenge-response authentication are used to determine if the display content has been hijacked (e.g., altered, replaced, etc.). The monitor module 116 can process the pixel encoding to determine if the video or image has been hijacked (see description of FIGS. 6-8 below). Alternatively or in addition, the monitor module 116 can output the embedded images for display on the display 119. Processing occurs in conjunction with the embedded images to determine if the display content has been hijacked (see description of FIGS. 2-5 below). Alternatively or in addition, the display output module 111 can perform the challenge-response authentication to determine if the display content has been hijacked (see description of FIG. 9 below). While described such that display output module 111 executing on the main processor 106 is creating display content with pixel encoding and/or embedded images, in some other example embodiments the video card module 114 in the video card 112 can perform some or all of the pixel encoding, inclusion of embedded images and/or challenge-response authentication on the display content 132 received from the display output module 111.

In response to detection (using pixel encoding, embedded images and/or challenge-response authentication) that the display content has been changed or altered, the monitor module 116 generates a hijacking notification 134 that is transmitted back to the display output module 111. The display output module 111 can perform a number of different corrective operations in response to the hijacking. For example, the display output module 111 can shut down the wagering game machine 100, log the error in nonvolatile memory, generate an error that is transmitted over a network to a backend server, shut down the display monitor 118, etc. Alternatively or in addition, the monitor module 116 can shut down the display monitor 118, without or without communication back to the display output module 111. Pixel encoding, embedded images and/or challenge-response authentication for monitoring changes or alterations in the display content can be performed together or separately.

In some example embodiments, the display output module 111 encrypts the display content that is being transmitted between the carrier board 104 and the display monitor 118. For example, the display content can be encrypted using High Bandwidth Digital Content Protection (HDCP). In another example, the encryption can be based on Public Key Infrastructure (PKI). The encryption can be a public key encryption (e.g., Diffie-Hellman, Rivest, Shamir and Adleman (RSA), etc.). The encryption can also be a private key encryption (e.g., (e.g., Data Encryption Standard (DES), Advanced Encryption Standard (AES)). In some example embodiments, Transport Layer Security (TLS) or Secure Sockets Layer (SSL) protocols are used for transmitting display content to from the carrier board 104 to the display monitor 118. The encryption can also include Pretty Good Privacy (PGP), GNU Privacy Guard (GPG), etc. These different types of encryption can further hinder a man-in-the-middle attack positioned between the different components within the wagering game machine 100. In particular, new hardware added by a third party would be required to decrypt the display content in order to replace or alter the display content. Also, this hardware would be required to re-encrypt the replaced or altered display content in accordance with the original encryption so that the monitor module 116 could decrypt prior to display.

In some example embodiments, the display output module 111 can alter different attributes of the display content 132 for transmission to the display monitor 118. The monitor module 116 would know the alterations so that the attributes of the display content 132 can be readjusted prior to display. For example, the display output module 111 can invert the coordinate system of the display content 132. Upon receipt, the monitor module 116 can reverse the inversion of the coordinate system prior to display. Other examples of attributes of the display content 132 that can be altered include refresh rates, resolutions, etc. For example, non-standard resolutions can be used. These alterations to the different attributes can also hinder third party hardware from altering or replacing the display content. In particular, the third party would be required to know of these alterations in order to properly add in their content. Otherwise, the altered display content can be set to the wrong coordinate system, refresh rate, resolution, etc.

In some example embodiments, the display output module 111 outputs the display content 132 at a refresh rate that is defined as a maximum refresh rate for the display monitor 118. In some example embodiments, the display output module 111 can output the display content 132 at horizontal and/or vertical refresh rates that are defined as maximum horizontal and/or vertical refresh rates for the display monitor 118. These defined maximum refresh rates can vary between different manufacturers and models of the display monitor 118, the rate supported by the video card 112 and the level of resolution used for displaying the display content 132. In some example embodiments, these refresh rates can be defined in ranges that are supported by the display monitor 118 but not supported by the third party hardware. If the third party hardware attempts to process at refresh rates beyond what can be supported, the third party hardware may lockup and cease operations because of its inability to process the frames at too high of a refresh rate.

In some example embodiments, the different secondary displays in the wagering game machine 100 are used as part of the wagering game play or potentially to have an effect on wagering game play. For example, the secondary displays can display different types of bonus play. Alternatively or in addition, the secondary display can display legal statements or disclaimers regarding wagering game play. In such embodiments, the secondary displays are not displaying a static image that does not affect wagering game play. If these secondary displays are only displaying static images that do not affect wagering game play, operators of the wagering game establishments may be more likely to authorize third parties to replace or add their content thereto. However, operators of the wagering game establishments may be more hesitant to allow third parties to replace or add third party display content in these secondary displays if such displays are part of or potentially effecting wagering game play. In particular, these operators may be concerned that game play would be adversely affected if the third party content were allowed.

In some example embodiments, the wagering game machine 100 is designed such that all power supplied to the wagering game machine 100 is used by components therein. Accordingly, if any third party hardware is added such that it is using the power supplied to the wagering game machine 100, the wagering game machine 100 becomes inoperable. Alternatively or in addition, logic (e.g., a circuit) within the wagering game machine 100 can monitor power usage. Such logic is provided with the amount of power to be used by all the components of the wagering game machine 100 (designed power usage). Such logic compares the designed power usage to the actual power usage. If the actual power usage is greater than designed power usage, the logic can perform one or more of the corrective operations (as described above).

In some example embodiments where the display comprises a touch screen, serial communications is used for communications between the touch screen and the carrier board 104. For example, a Universal Serial Bus (USB) can be used for this communication.

In some situations, a third party may attempt to subvert the monitoring of third party content by replacing the display monitor 118 with a different display monitor. In some example embodiments, the display output module 111 can attempt to check for this change of the display monitor. In particular, the display monitor 118 can comprise a nonvolatile memory that is configured to store Enhanced Display Information Data (EDID). The EDID can include the serial number, native resolution, manufacturer, etc. that are specific to the display monitor 118. In some example embodiments, the display output module 111 can retrieve the EDID data. The display output module 111 can then compare this retrieved data to a second set of data in another nonvolatile memory in the wagering game machine (e.g., a Read Only Memory (ROM) on the carrier board 104). The second set of data includes the serial number, native resolution, manufacturer, etc. that are specific to the display monitor 118. If the retrieved data does not match the second set of data, the display output module 111 can perform a corrective operation. In some example embodiments, the display output module 111 can perform this check of the EDID at different times when the wagering game machine 100 is powered on. For example, the display output module 111 can perform this check at boot up, periodic times after boot up, after a jackpot win, after a different monitoring operation indicates that a hijacking is occurring, etc.

Figure 2:
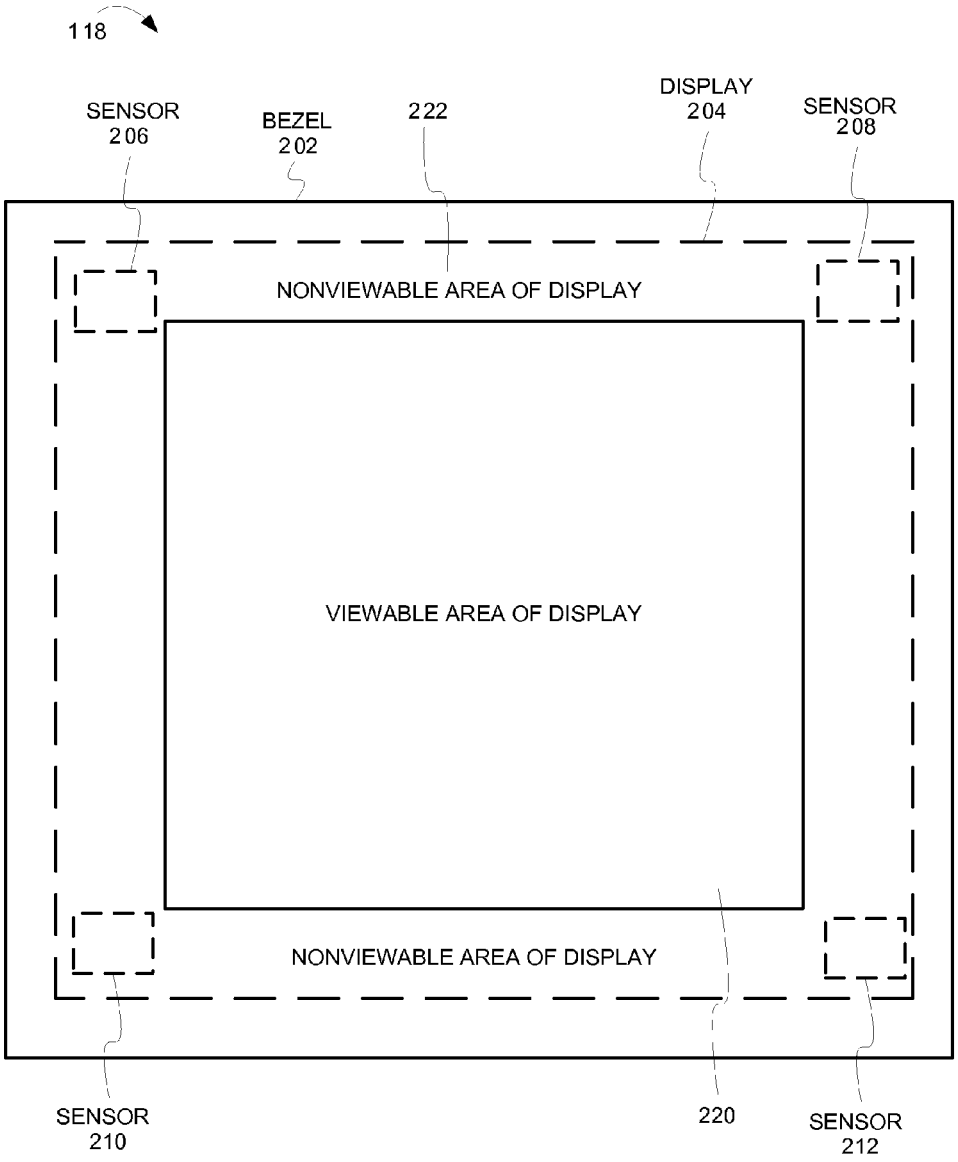
FIG. 2 is a more detailed block diagram of a display monitor, according to some example embodiments.

FIG. 2 is a more detailed block diagram of a display monitor, according to some example embodiments. In particular, FIG. 2 illustrates an example of the display monitor 118 of FIG. 1. In this example, sensors are hidden behind a bezel that covers edges of the display. The sensors are used to monitor what is actually being displayed on the display monitor 118.

The display monitor 118 includes a display 204 that includes a viewable area of display 220 and a nonviewable area of display 222. A bezel 202 covers the nonviewable area of display 222 to prevent this area from being viewed. In this example, the bezel 202 covers all four edges of the display 202. In other examples, the bezel 202 can cover less than all edges (e.g., the top and bottom edges), a part of one or more edges, etc. In this example, the display monitor 118 includes four sensors at the four corners of the display 204 that are hidden behind the bezel 202. The display monitor 118 includes a sensor 206, a sensor 208, a sensor 210, and a sensor 212. In some example embodiments, the sensors 206-212 comprise any one of a Charged-Coupled Device (CCD) sensor, Complimentary Metal-Oxide Semiconductor (CMOS) sensor, etc. In other examples, the display monitor 118 can comprise more or less sensors, sensors in other locations, etc. For example, the display monitor 118 can comprise a single sensor positioned anywhere along the top edge of the display 204. In another example, the display monitor 118 can comprise two sensors positioned anywhere along opposing edges of the display 204. As further described below, the sensors 206-212 capture a part of the display content 132. The monitor module 116 of FIG. 1 can then determine whether the captured display content is the originally display content transmitted by the display output module 111. Alternatively or in addition, the captured display content can be transmitted back to the carrier board 104. The display output module 111 can make this determination. These operations are described with reference to FIGS. 3-6.

In some example embodiments, the display output module 111 can output different images into the part of the display content that is being monitored by the sensors 206-212. These different images can include individual pixel, multiple pixels in a defined area, bar code elements, watermarks, etc.

These example embodiments that incorporate sensors into the display monitor 118 are farther down the chain to where the display content is actually being displayed in comparison to other methods for detecting changes to the display content. Accordingly, these example embodiments that monitor what is actually displayed can make hijacking of the display by third parties more difficult.

Example Operations

This section describes operations associated with some example embodiments. In the discussion below, the flowcharts are described with reference to the block diagrams presented above. However, in some example embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flowchart.

This section describes FIGS. 3-14. This section provides discussion of different flowcharts for monitoring display of third party content. This section also provides discussion of example pixel configurations to help illustrate the operations of the flowcharts. The discussion of FIG. 3 describes an example pixel configuration of an embedded image. The discussion of FIGS. 4-5 describes operations for monitoring display third party content using embedded images and sensors positioned behind a bezel of a display monitor. The discussion of FIG. 6 describes an example pixel configuration of a single frame pixel encoding. The discussion of FIGS. 7-8 describes operations for monitoring third party content using single pixel encoding. The discussion of FIG. 9 describes example pixels across multiple frames for sequential multi-frame pixel encoding. The discussion of FIGS. 10-12 describes operations for monitoring third party content using sequential multi-frame pixel encoding. The discussion of FIG. 13 describes operations for a challenge-response authentication for monitoring third party content. The discussion of FIG. 14 describes operations for authenticating authorized third party content for display.

Figure 3:
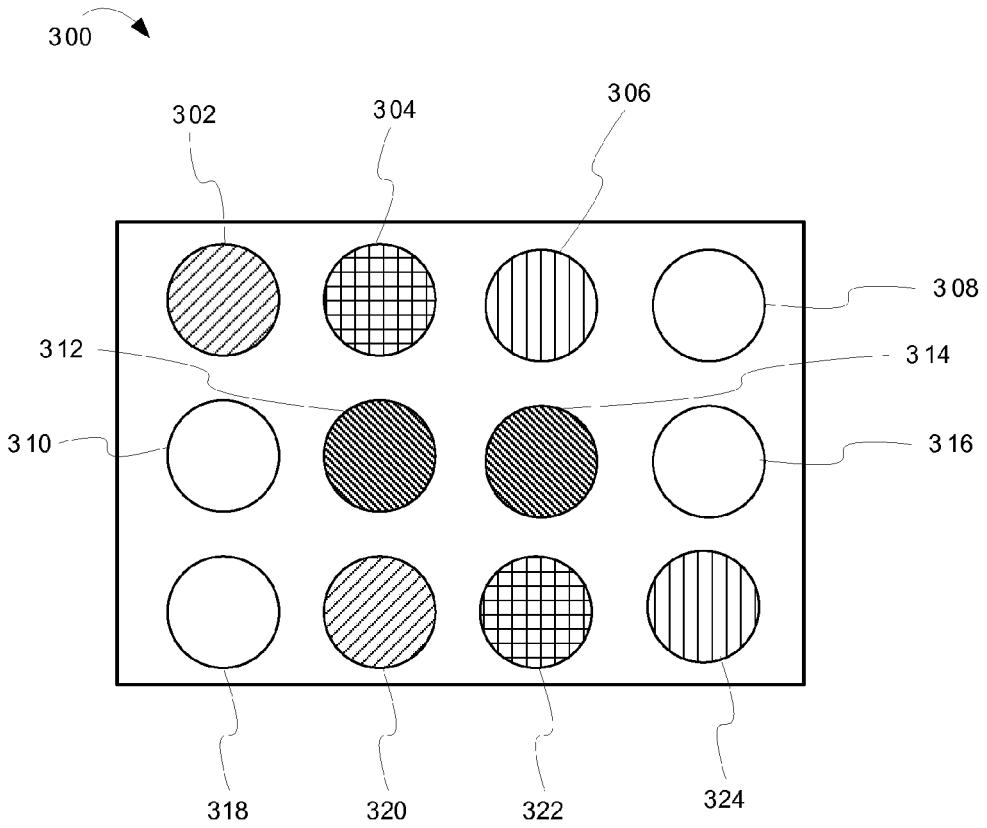
FIG. 3 is an example of an embedded image in the display content captured by a sensor for monitoring display of third party content, according to some example embodiments.

Monitoring of Unauthorized Third Party Content by Sensors Behind a Bezel of the Display Monitor FIG. 3 is an example of an embedded image in the display content captured by a sensor for monitoring display of third party content, according to some example embodiments. With reference to FIG. 2, one of the sensors 206-212 captured the embedded image 300. The embedded image 300 includes a number of pixels (pixels 302-324) having different pixel values. In particular, different pixel values are represented by different patterns. Pixels 302 and 320 have a same pixel value. Pixels 304 and 322 have a same pixel value. Pixels 306 and 324 have a same pixel value. Pixels 308, 310, 316 and 318 have a same pixel value. Pixels 312 and 316 have a same pixel value. As further described below, one of the sensors 206-212 captures the pixel values for each of the different pixel locations. The sensors 206-212 can capture one to any number of pixels. Therefore, the embedded image 300 can range from a single pixel to a large number of pixels that display an image (e.g., barcode, watermark, etc.). In this example, the embedded image 300 comprises 12 pixels.

Figure 4:
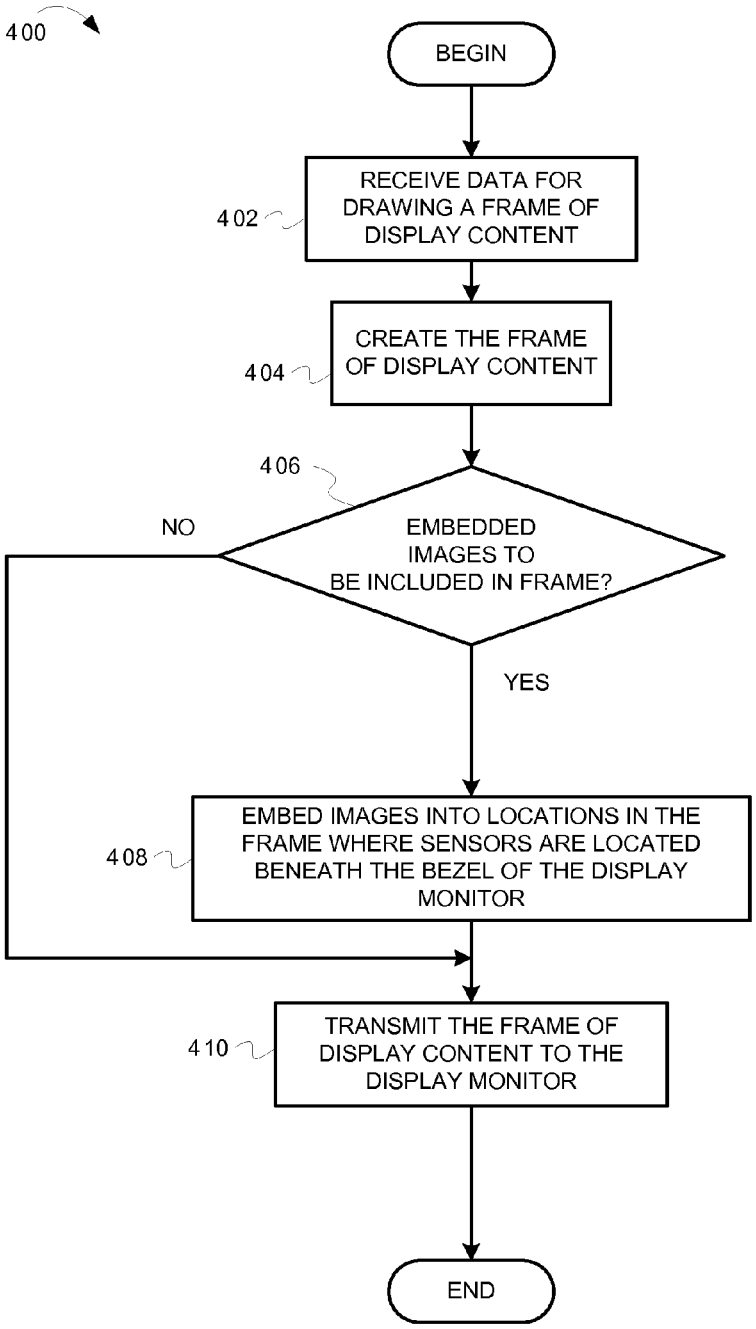
FIG. 4 is a flowchart of operations for embedding an image that is used to monitor display of third party content on a display monitor of a wagering game machine, according to some example embodiments.

FIG. 4 is a flowchart of operations for embedding an image that is used to monitor display of third party content on a display monitor of a wagering game machine, according to some example embodiments. In this example, operations of a flowchart 400 are performed by the display output module 111 executing on the main processor 106 (see FIG. 1). The operations of the flowchart 400 begin at block 402.

At block 402, the display output module 111 receives data for drawing a frame of display content. For example, the display output module 111 may receive data for a result of a bonus event from wagering game play from the wagering game module 110. In another example, the display output module 111 can receive data for displaying a video that is part of the theme of wagering game machine, data for outputting a still image of a legal disclaimer, data for outputting video or still images that is part of the wagering game play, etc. The operations of the flowchart 400 continue at block 404.

At block 404, the display output module 111 creates the frame of display content. The display output module 111 determines the number of pixels and their locations based on the resolution, size, etc. of the frame. The display output module 111 also sets the values for the pixels in the frame. The operations of the flowchart 400 continue at block 406.

At block 406, the display output module 111 determines whether embedded images are to be included in the frame. The display output module 111 can embed one to N number of images into every frame or just selected frames. In some applications, embedded images are added in every frame. In other applications, the embedded images are periodically added to the frame (e.g., every other frame, once per second, etc.) or are randomly added in a frame. Whether to embed images into every frame or just selected frames can be preset or dynamically determined. For example, for a predefined time period after boot-up or powering on of the wagering game machine, the display output module 111 can add to every frame. And, after the expiration of this predefined time period, the display output module 111 can randomly add the images to a frame. If embedded images are to be included in the frame, the operations of the flowchart 400 continue at block 408. Otherwise, operations continue at block 410.

At block 408, the display output module 111 embeds images into locations in the frame where sensors are located beneath the bezel of the display monitor that is to display the frame. Accordingly, the display output module 111 can define one more pixel values to create these images. The display output module 111 can create one to N number of embedded images. The embedded images are located in positions on the frame such that the sensors in the bezel can scan and determine the pixel values that comprise the images. With reference to the example of FIG. 2, the display output module 111 can embed four images at the four corners of the frame in line of sight of the sensors 206-212. An embedded image can comprise one to N number of pixels. With reference to the example of FIG. 3, the embedded image comprises a 4×3 pixel area. This pixel area includes pixels 302-324 having different values. In some example embodiments, the locations and the embedded image itself are randomized. The embedded images can be randomized relative to size, content, etc. In some applications, the display output module 111 can randomize which sensors are to have an image in their line of sight for a given frame. In others words, an embedded image is not necessarily included for each of the sensors each time. For example, with reference to FIG. 2, the display output module 111 can position embedded images in front of the sensor 206-208 for one frame and position embedded images in front of the sensors 210-212 in a different frame. The operations of the flowchart 400 continue at block 410.

At block 410, the display output module 111 transmits the frame of display content to the display monitor 118. With reference to FIG. 1, the display output module 111 can transmit the frame of display content over the bus 130 to the video card 112 and over the bus 133 to the display monitor 118 (shown as the display content 132). The embedding of images can be used in conjunction with other example embodiments described herein. For example, the display content 132 can be encrypted. Alternatively or in addition, the bus 133 can be an armored and/or epoxied cable. Alternatively on in addition, the operations of pixel encoding as described in reference to FIGS. 6-8 can also be performed. The operations of the flowchart 400 are complete.

Figure 5:
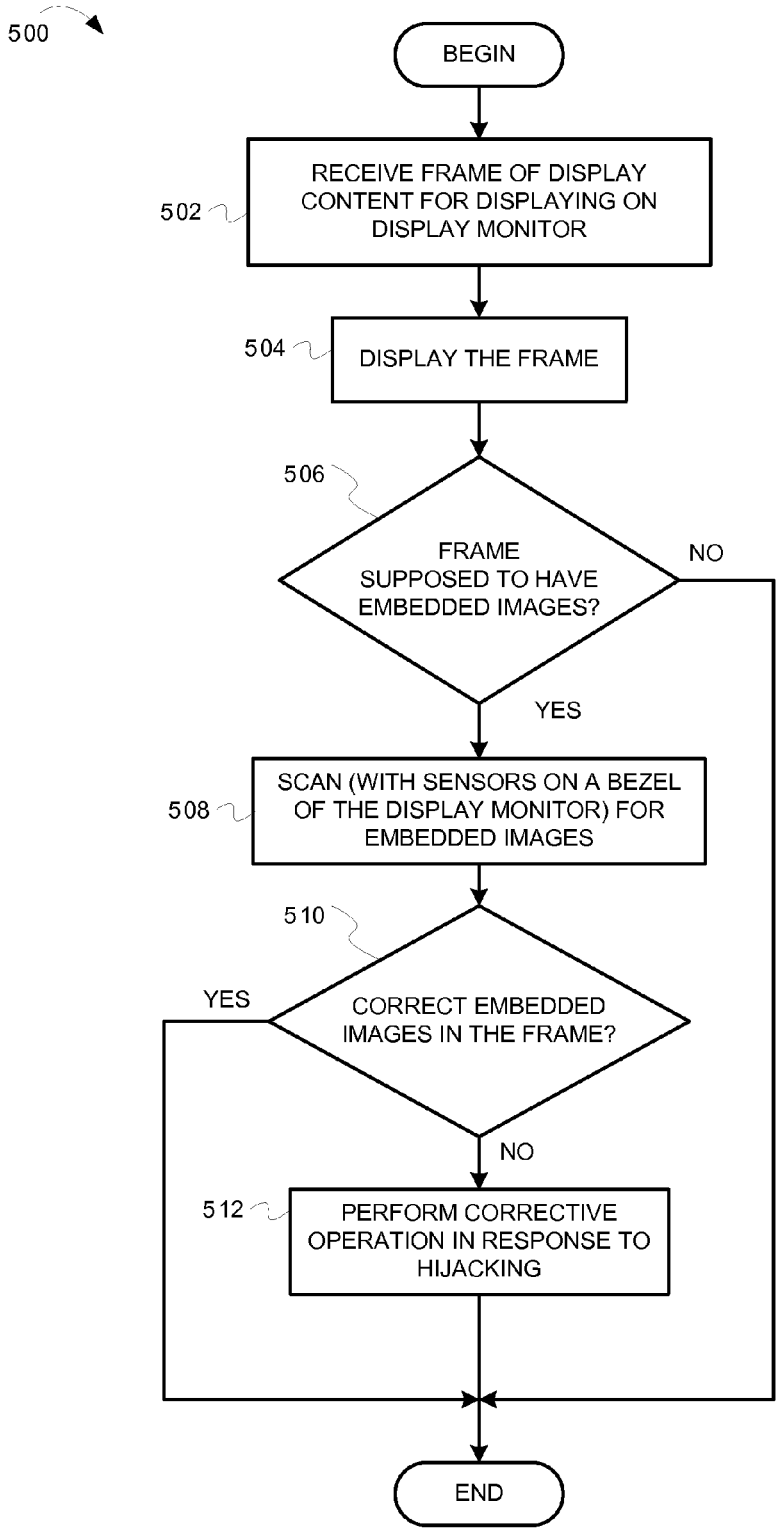
FIG. 5 is a flowchart of operations for monitoring display of third party content on a display monitor of a wagering game machine using embedded images and sensors on a bezel of the display monitor, according to some example embodiments.

FIG. 5 is a flowchart of operations for monitoring display of third party content on a display monitor of a wagering game machine using embedded images and sensors on a bezel of the display monitor, according to some example embodiments. In this example, operations of a flowchart 500 are performed by the monitor module 116 and the sensors on the bezel the display monitor 118. Also, at least some of the operations can be performed by at least one of the display output module 111 and the video card module 114 (as further described below). The operations of the flowchart 500 begin at block 502.

At block 502, the monitor module 116 receives frame of display content for displaying on the display monitor 118. With reference to FIG. 1, the monitor module 116 can receive the frame from the display output module 111 over the bus 130 and the bus 133 through the video card 112. The operations of the flowchart 500 continue at block 504.

At block 504, the monitor module 116 displays the frame on the display monitor 118. With reference to the example of FIG. 2, the monitor module 116 can display the frame on the display 204 (including the viewable area of display 220 and the nonviewable area of display 222). The operations of the flowchart 500 continue at block 506.

At block 506, the monitor module 506 determines whether the frame that is being displayed is supposed to have embedded images. As described above, one to N number of images can be embedded into every frame or just selected frames. In some applications, embedded images are added in every frame. In other applications, the embedded images are periodically added to the frame (e.g., every other frame, once per second, etc.) or are randomly added in a frame. Whether to embed images into every frame or just selected frames can be preset or dynamically determined. If there are supposed to be embedded images in the frame operations of the flowchart 500 continue at block 507. Otherwise, the operations of the flowchart 500 are complete.

At block 508, sensors on a bezel of the display monitor 118 scan for the embedded images. With reference to the example of FIG. 2, one or more of the sensors 206-212 scan the image that is displayed in their line of sight on the display 204. The scanned image can include pixel values for the different pixels captured based on the amount of captured light for the given pixel locations. An embedded image can comprise one to N number of pixels. With reference to the example of FIG. 3, the embedded image comprises a 4×3 pixel area. This pixel area includes pixels 302-324 having different values. In some example embodiments, the locations and the embedded image itself are randomized. The embedded images can be randomized relative to size, content, etc. For example, the sensor 206 may scan a first image, while the sensor 212 may scan a second image (of different size, content, etc.). In others words, an embedded image is not necessarily included for each of the sensors on a bezel each time. The operations of the flowchart 500 continue at block 510.

At block 510, the display output module 111 determines whether the correct embedded images are in the frame being displayed on the display monitor 118. In particular, the sensors on the bezel are communicatively coupled to the display output module 111. For example, the sensors can communicate the scanned images back to the display output module 111 through the monitor module 116 and back through the buses 133 and 130. Alternatively, the display output module 111 and the sensors can be communicatively coupled together through a separate bus (e.g., USB). The sensors transmit the scanned images to the display output module 111. The display output module 111 can process the scanned images to determine whether the scanned images are equal to the embedded images that were originally placed in the frame by the display output module 111. The display output module 111 can perform a pixel-by-pixel comparison between the scanned images and the original embedded images. For a given image, if each pixel value is equal, the display output module 111 assumes that the correct embedded images are in the frame being displayed on the display monitor 118. If not, the image is considered to have been changed at some point between when the image was created by the display output module 111 and when the image was displayed on the display monitor 118. For example, a third party hardware may have replaced the display content with a third party content. Alternatively, the third party hardware may have added a third party content to the display content, thereby distorting the original display content. Also while described such that the display output module performs this determination, in some other example embodiments the monitor module 116 and/or the video card module 114 can perform this determination (instead of the display output module 111). If the correct images are in the frame, the operations of the flowchart 500 are complete. Otherwise, operations continue at block 512.

At block 512, the display output module 111 performs one or more corrective operations in response to hijacking of the display content for the display monitor 118. For example, the display output module 111 can shut down the wagering game machine 100, log the error in nonvolatile memory, generate an error that is transmitted over a network to a backend server, shut down the display monitor 118, etc. The operations of the flowchart 500 are complete.

Figure 6:
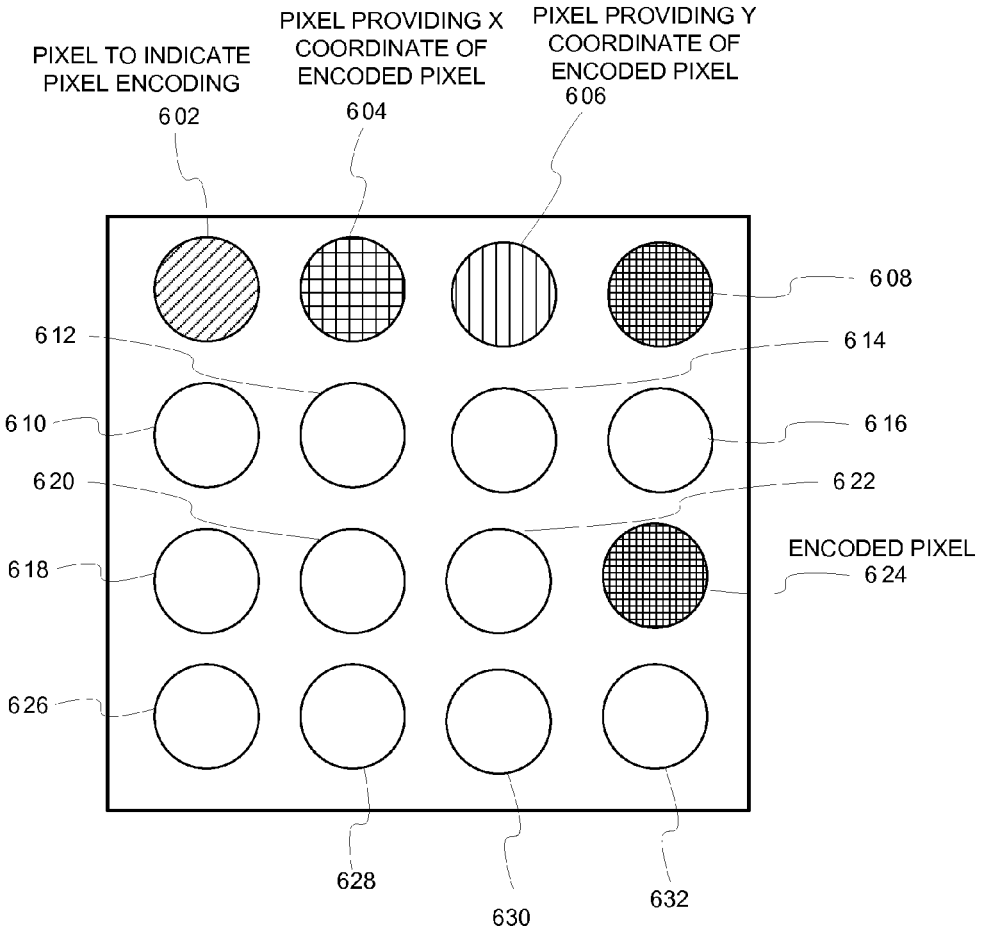
FIG. 6 is an example of a number of pixels (used for single pixel encoding) within a frame for display on a display monitor of a wagering game machine, according to some example embodiments.
Figure 7:
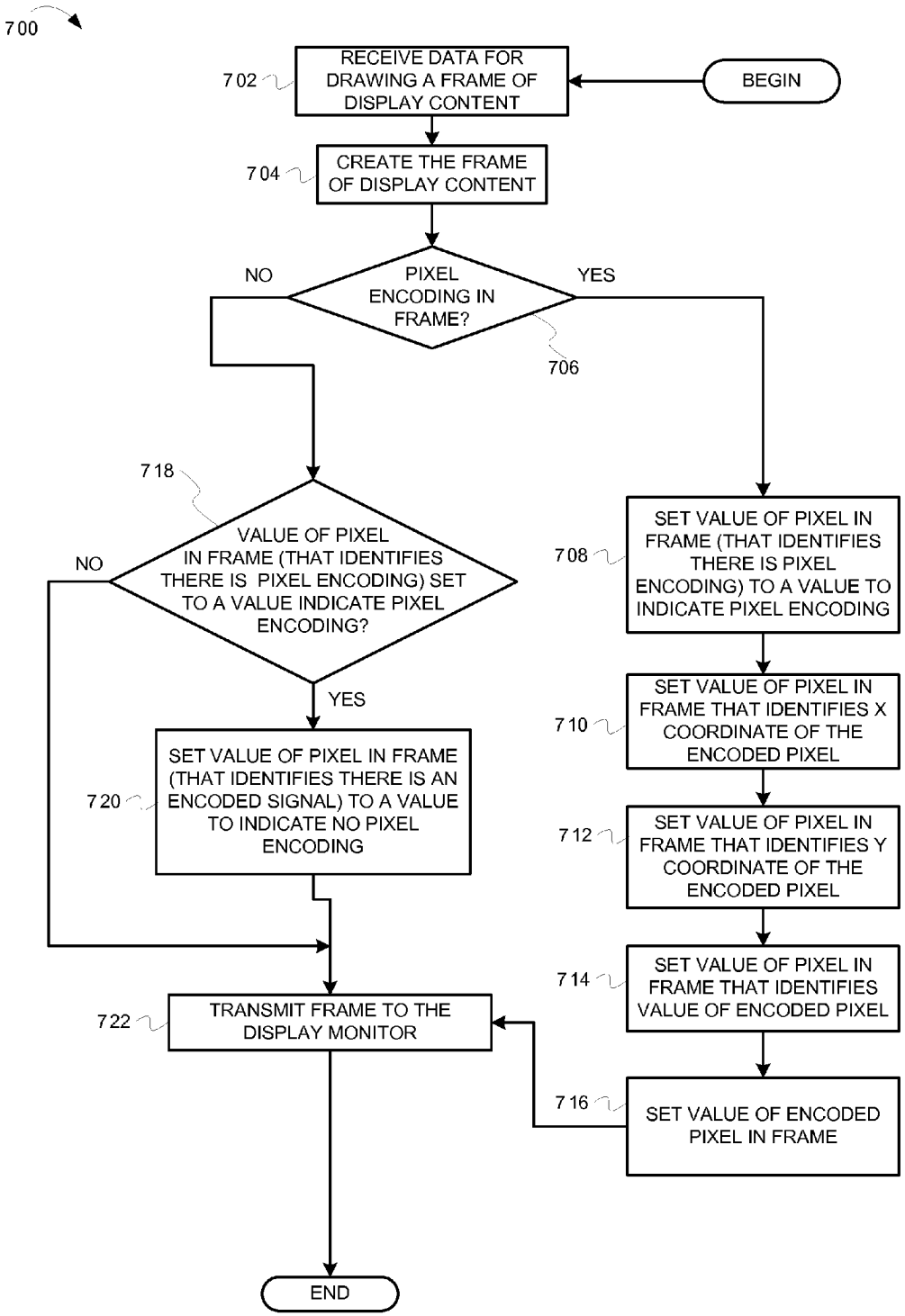
FIG. 7 is a flowchart of operations for single pixel encoding that is used to monitor display of third party content on a display monitor of a wagering game machine, according to some example embodiments.
Figure 8:
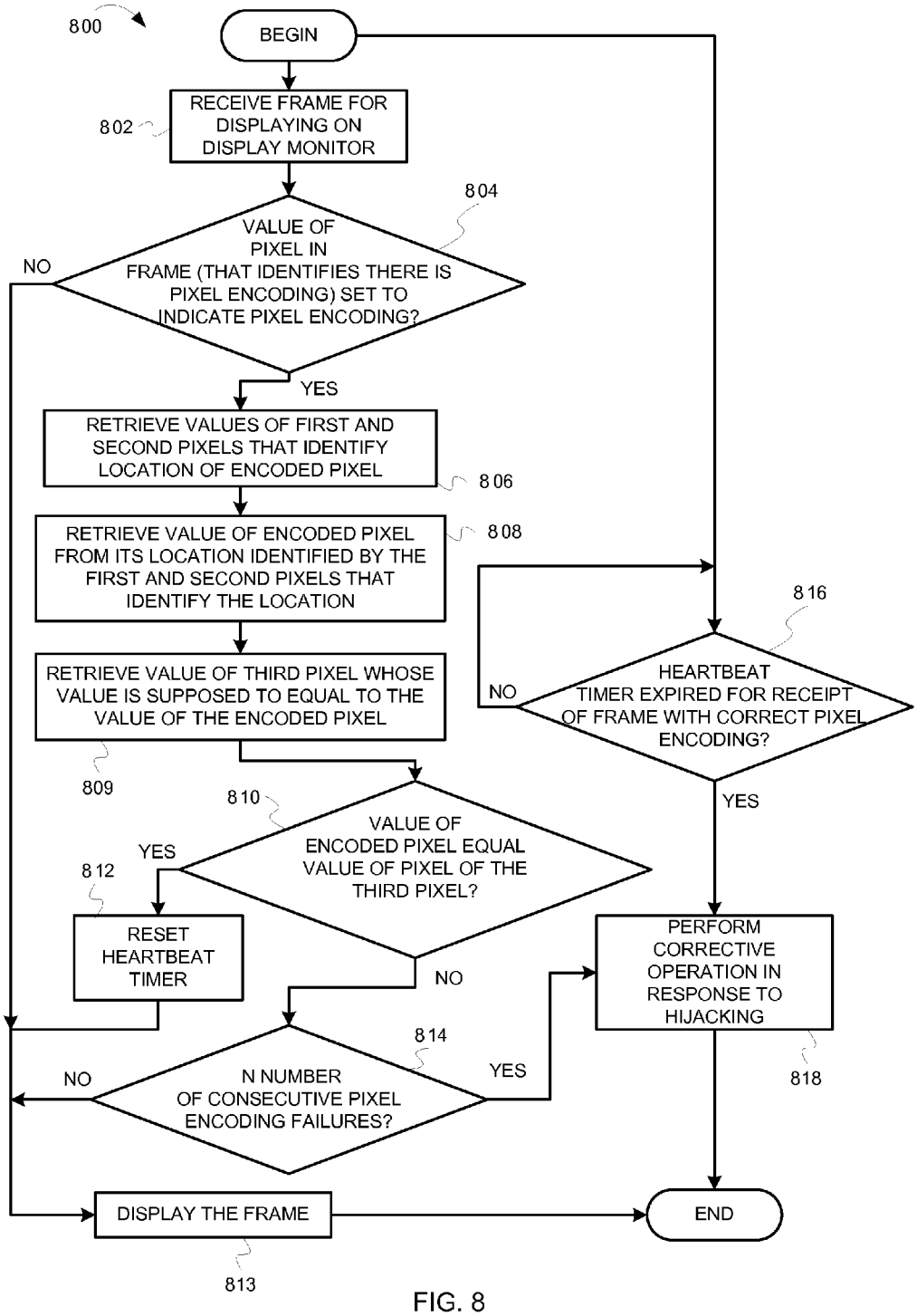
FIG. 8 is a flowchart of operations for monitoring display of third party content on a display monitor of a wagering game machine using single pixel encoding, according to some example embodiments.

Monitoring of Unauthorized Third Party Content Using Single Frame Pixel Encoding Another example embodiment for monitoring third party content on a display of a wagering game machine is now described. In particular, FIGS. 6-8 illustrate monitoring of third party content using single pixel encoding, according to some example embodiments. FIG. 6 illustrates an example of pixels (used for pixel encoding) that are within a frame to be displayed on a display monitor of a wagering game machine. FIGS. 7-8 include flowcharts of operations for single pixel encoding.

FIG. 6 is an example of a number of pixels (used for single frame pixel encoding) within a frame for display on a display monitor of a wagering game machine, according to some example embodiments. FIG. 6 includes 16 different pixels (pixels 602-632). Pixels 602, 604, 606, 608 and 624 have defined pixel values that are represented by different patterns. The pixel 602 is a pixel whose value defines whether this frame of display content has pixel encoding or not. For example, if the RGB value of the pixel 602 is (0, 235, 52), there is pixel encoding. If the RGB value of the pixel 602 is any other value, there is no pixel encoding.

If there is pixel encoding, the value of the pixel 604 identifies the X coordinate of an (X,Y) position of the encoded pixel. Also, the value of the pixel 606 identifies the Y coordinate of the (X,Y) position of the encoded pixel. Additionally if there is pixel encoding, the value of the pixel 608 is what the value of the encoded pixel should equal. The pixel 624 is the encoded pixel.

For this example, assume that the pixel 602 is at the (0,0) position. Assuming pixel encoding, the RGB value of the pixel 602 is (0, 235, 52). The encoded pixel (the pixel 624) has an (X,Y) position of (4,3). Therefore, the pixel 604 is embedded with a value 4, and the pixel 606 is embedded with a value of 3. Also, both the pixel 608 and the encoded pixel 624 are embedded with a same value. As further described below, if these two values are not equal, the pixel encoding has failed.

FIG. 7 is a flowchart of operations for single frame pixel encoding that is used to monitor display of third party content on a display monitor of a wagering game machine, according to some example embodiments. In this example, operations of a flowchart 700 are performed by the display output module 111 executing on the main processor 106 (see FIG. 1). The operations of the flowchart 700 begin at block 702.

At block 702, the display output module 111 receives data for drawing a frame of display content. For example, the display output module 111 may receive data for a result of a bonus event from wagering game play from the wagering game module 110. In another example, the display output module 111 can receive data for displaying a video that is part of the theme of wagering game machine, data for outputting a still image of a legal disclaimer, data for outputting video or still images that is part of the wagering game play, etc. The operations of the flowchart 700 continue at block 704.

At block 704, the display output module 111 creates the frame of display content. The display output module 111 determines the number of pixels and their locations based on the resolution, size, etc. of the frame. The display output module 111 also sets the values for the pixels in the frame. The operations of the flowchart 700 continue at block 706.

At block 706, the display output module 111 determines whether there is pixel encoding in this frame. The display output module 111 can perform pixel encoding into every frame or just selected frames. In some applications, pixel encoding occurs in every frame. In other applications, pixel encoding occurs periodically (e.g., every other frame, once per second, etc.) or randomly. Whether to pixel encode into every frame or just selected frames can be preset or dynamically determined. For example, for a predefined time period after boot-up or powering on of the wagering game machine, the display output module 111 can pixel encode every frame. And, after the expiration of this predefined time period, the display output module 111 can randomly pixel encode. If there is pixel encoding, the operations of the flowchart 700 continue at block 708. Otherwise, operations continue at block 722.

At block 708, the display output module 111 sets the value of the pixel in the frame (that identifies that there is pixel encoding) to a value to indicate pixel encoding. With reference to FIG. 6, the pixel 602 is the pixel whose value indicates whether there is pixel encoding or not. Therefore, the display output module 111 sets this pixel to a value to indicate pixel encoding. As further described below, this will enable the monitor module 116 at the display monitor 118 to determine whether pixel encoding is within a received frame. Operations of the flowchart 700 continue at block 710.

At block 710, the display output module 111 sets the value of the pixel in the frame that identifies the X coordinate of the (X,Y) position of the encoded pixel in the frame. The (X,Y) position of the encoded pixel can change or remain constant across different frames. In some example embodiments, the (X,Y) position of the encoded pixel randomly changes across different frames. With reference to FIG. 6, the pixel 604 is the pixel whose value is set to the X coordinate of the encoded pixel in the frame. With reference to FIG. 6, the pixel 602 is at the (0,0) position, and the encoded pixel (the pixel 624) has an (X,Y) position of (4,3). Therefore, the pixel 604 would be set to a value of 4. The display output module 111 embeds the value of 4 into the pixel 604. Operations of the flowchart 700 continue at block 712.

At block 712, the display output module 111 sets the value of the pixel in the frame that identifies the Y coordinate of the (X,Y) position of the encoded pixel in the frame. With reference to FIG. 6, the pixel 606 is the pixel whose value is set to the Y coordinate of the encoded pixel in the frame. With reference to FIG. 6, the Y coordinate for the encoded pixel 624 is 3. Therefore, the display output module 111 embeds the value of the 3 into the pixel 606. Operations of the flowchart 700 continue at block 714.

At block 714, the display output module 111 sets the value of the pixel in the frame that identifies the value of the encoded pixel. In other words, a separate pixel in the frame is set to a value that should be equal to the value of the encoded pixel (assuming that the display content of the frame has not been changed by third party hardware). With reference to FIG. 6, the pixel 608 is the pixel whose value is set to the value of the encoded pixel. The value of the encoded pixel can change or remain constant across different frames. In some example embodiments, the value of the encoded pixel randomly changes across different frames. With reference to FIG. 6, the display output module 111 sets the value of the pixel 608 to equal a value of the encoded pixel 624. Operations of the flowchart 700 continue at block 716.

At block 716, the display output module 111 sets the value of the encoded pixel in the frame. With reference to FIG. 6, the pixel 624 is the encoded pixel whose value is set. The display output module 111 sets the pixel 608 and the pixel 624 to the same value. As further described below, the monitor module 116 checks whether the values of these pixels are equal in order to determine whether original display content of the frame has been changed (e.g., by third party hardware). Operations of the flowchart 700 continue at block 722 (described below).

Returning to the "no" decision at block 706 (no pixel encoding in the frame) at block 718, the display output module 111 determines whether the value of the pixel in the frame (that identifies there is pixel encoding) is set to a value to indicate pixel encoding. As described above, a designated pixel having a particular value indicates that pixel encoding is within the frame. Accordingly, the display output module 111 needs to ensure that this designated pixel has not been accidently set to this particular value as part of the creating of the frame (at block 704). If the value of the pixel in the frame (that identifies there is pixel encoding) is set to a value to indicate pixel encoding, operations of the flowchart 700 continue at block 720. Otherwise, operations of the flowchart 700 continue at block 722.

At block 720, the display output module 111 sets the value of the pixel in the frame (that identifies there is pixel encoding) to a value to indicate no pixel encoding. In particular, the display output module 111 can set this value to any value but the particular value that indicates pixel encoding. If this check at block 718 and setting at block 720 is not done, the monitor module 116 at the display monitor 118 may receive a frame that does not include pixel encoding but process such frame as if there is pixel encoding. In particular, if this pixel is accidently set to indicate pixel encoding for a frame that does not include pixel encoding, the monitor module 116 may mark the frame as being changed by third party hardware (hijacking) Operations of the flowchart 700 continue at block 722.

At block 722, the display output module 111 transmits the frame of display content to the display monitor 118. With reference to FIG. 1, the display output module 111 can transmit the frame of display content over the bus 130 to the video card 112 and over the bus 133 to the display monitor 118 (shown as the display content 132). The pixel encoding can be used in conjunction with other example embodiments described herein. For example, the display content 132 can be encrypted. Alternatively or in addition, the bus 133 can be an armored and/or epoxied cable. Alternatively on in addition, the operations of embedded images as described in reference to FIGS. 3-5 can also be performed. The operations of the flowchart 700 are complete.

FIG. 8 is a flowchart of operations for monitoring display of third party content on a display monitor of a wagering game machine using single pixel encoding, according to some example embodiments. In this example, the operations of a flowchart 800 are performed by the monitor module 116. The operations of the flowchart 800 include two sets of operations that can operate independent of each other. The two sets of operations are relevant to the monitoring of third party content using pixel encoding and share a same block (818). A first set of operations (blocks 802-814 and 818) are to process individual frames to determine if and whether there is correct pixel encoding. A second set of operations (block 816-818) monitor a heartbeat timer to ensure that a frame with correct pixel encoding is received within a defined time period. The first set of operations can commence upon receipt of a frame for displaying on the display monitor 118. The second set of operations can commence after the display monitor 118 is powered on or rebooted. The first set of operations begins at block 802.

At block 802, the monitor module 116 receives a frame of display content for displaying on the display monitor 118. With reference to FIG. 1, the monitor module 116 can receive the frame from the display output module 111 over the bus 130 and the bus 133 through the video card 112. The operations of the flowchart 800 continue at block 804.

At block 804, the monitor module 116 determines whether the value of the pixel in the frame (that identifies there is pixel encoding in the frame) is set to indicate pixel encoding. With reference to FIG. 2, the monitor module 116 would determine whether the value of the pixel 602 is set to the particular value that indicates pixel encoding. For example, if the RGB value of the pixel 602 is (0, 235, 52), there is pixel encoding. If the RGB value of the pixel 602 is any other value, there is no pixel encoding. If the value of the pixel in the frame (that identifies there is pixel encoding in the frame) is set to indicate pixel encoding, the operations of the flowchart 800 continue at block 806. Otherwise, the operations of the flowchart 800 continue at block 820.

At block 806, the monitor module 116 retrieves the values of the first and second pixels that identify the location of the encoded pixel. With reference to FIG. 6, the monitor module 116 retrieves the values of the pixel 604 (X coordinate) and the pixel 606 (Y coordinate). In this example, the X,Y location of the encoded pixel is (4,3). The operations of the flowchart 800 continue at block 808.

At block 808, the monitor module 116 retrieves the value of the encoded pixel from its location identified by the first and second pixels that identify the location. With reference to FIG. 6, the encoded pixel 624 is located at position (4,3). The operations of the flowchart 800 continue at block 810.

At block 809, the monitor module 116 retrieves the value of a third pixel whose value is supposed to equal the value of the encoded pixel. In particular, the display output module 111 sets the value of this pixel and the encoded pixel to a same value (as described above). With reference to FIG. 6, this third pixel is the pixel 608.

At block 810, the monitor module 116 determines whether the value of the third pixel (whose value is supposed to equal the value of the encoded pixel) is equal to the value of the encoded pixel. With reference to FIG. 6, the monitor module 116 determines whether the value of the pixel 608 is equal to the value of the encoded pixel 624. If these values are not equal, the monitor module 116 assumes that the original display content has been changed since its creation by the display output module 111. In particular, the display output module 111 had set both pixels to the same value prior to transmitting the frame to the display monitor 118. For example, third party hardware may have intercepted the frame and added third party content to the frame, thereby changing or replacing the original display content. If the value of the third pixel is equal to the value of the encoded pixel, the operations of the flowchart 800 continue at block 812. Otherwise, the operations continue at block 814.

At block 812, the monitor module 116 resets a heartbeat timer. The heartbeat timer is a timer for tracking the amount of time that has expired since a frame with the correct pixel encoding has been received. Specifically, the timer is for tracking the amount of time that has expired since a frame having pixel encoding has been received, wherein the value of the pixel (whose value is supposed to be equal to the value of the encoded pixel) is equal to the value of the encoded pixel (see description of operations at block 810 above). In this situation, the monitor module 116 did receive a frame with correct pixel encoding. Accordingly, the monitor module 116 resets the heartbeat timer. If the heartbeat timer expires, the monitor module 116 performs one or more corrective operations in response to hijacking. This monitoring of the heartbeat timer is discussed in the description of block 816 (see description below). The operations of the flowchart 800 continue at block 813.

At block 813, the monitor module 116 displays the frame on the display monitor 118. The operations of the flowchart 800 are complete along this path.

Returning to the "no" decision at block 810 wherein the values of the two pixels are not equal, at block 814, the monitor module 116 determines whether there have been N number of consecutive pixel encoding failures. N can be set to any value of one or greater. A pixel encoding failure occurs after the monitor module 116 receives a frame with incorrect pixel encoding. Specifically, a pixel encoding failure occurs when a frame with pixel encoding is received, wherein the value of the pixel (whose value is supposed to be equal to the value of the encoded pixel) is equal to the value of the encoded pixel (see description of operations at block 810 above). If there have not been N number of consecutive pixel encoding failures, the operations of the flowchart 800 continue at block 813 (described above). Otherwise, operations continue at block 818 (described below).

The second set of operations of the flowchart 800 is now described. As described above, the second set of operations can commence after the display monitor 118 is powered on or rebooted and can be independent of the first set of operations. The second set of operations begins at block 816.

At block 816, the monitor module 116 determines whether the heartbeat timer has expired for receipt of a frame with correct pixel encoding. The heartbeat timer can be set to any time value (e.g., 1 second, 5 seconds, 90 seconds, etc.). The heartbeat timer can then countdown to zero. The heartbeat timer expires after reaching a value of zero. Also, as noted above at block 812, the heartbeat timer can be reset to its initial value (e.g., 1 second, 5 seconds, 90 seconds, etc.) to restart the countdown if the monitor module 116 receives a frame with the correct pixel encoding. If the heartbeat timer has not expired, the operations remain at block 816 where the monitor module 116 checks for expiration of the heartbeat timer. This check of the expiration can occur periodically (e.g., every 0.5 seconds, every 1 second, etc.). If the heartbeat timer has expired, the operations of the flowchart 800 continue at block 818.

At block 818, the monitor module 116 performs one or more corrective operations in response to hijacking of the display content for the display monitor 118. For example, the monitor module 116 can shut down the wagering game machine 100, log the error in nonvolatile memory, generate an error that is transmitted over a network to a backend server, shut down the display monitor 118, etc. With reference to FIG. 1, these operations can occur when the monitor module 116 sends the hijacking notification 134 back to the display output module 111. The display output module 111 can perform some of these operations. Alternatively or in addition, the monitor module 115 can shut down the display monitor 118, independent of communication with the display output module 111. Accordingly as described, the monitor module 116 can perform one or more corrective operations in response to 1) N number of consecutive pixel encoding failures (see block 814) or 2) expiration of the heartbeat timer after not receiving a frame with correct pixel encoding. The operations of the flowchart 800 are complete. In some example embodiments, even after performing one or more corrective operations (at block 818), the monitor module 116 can still display the frame on the display monitor 118.

Figure 9:
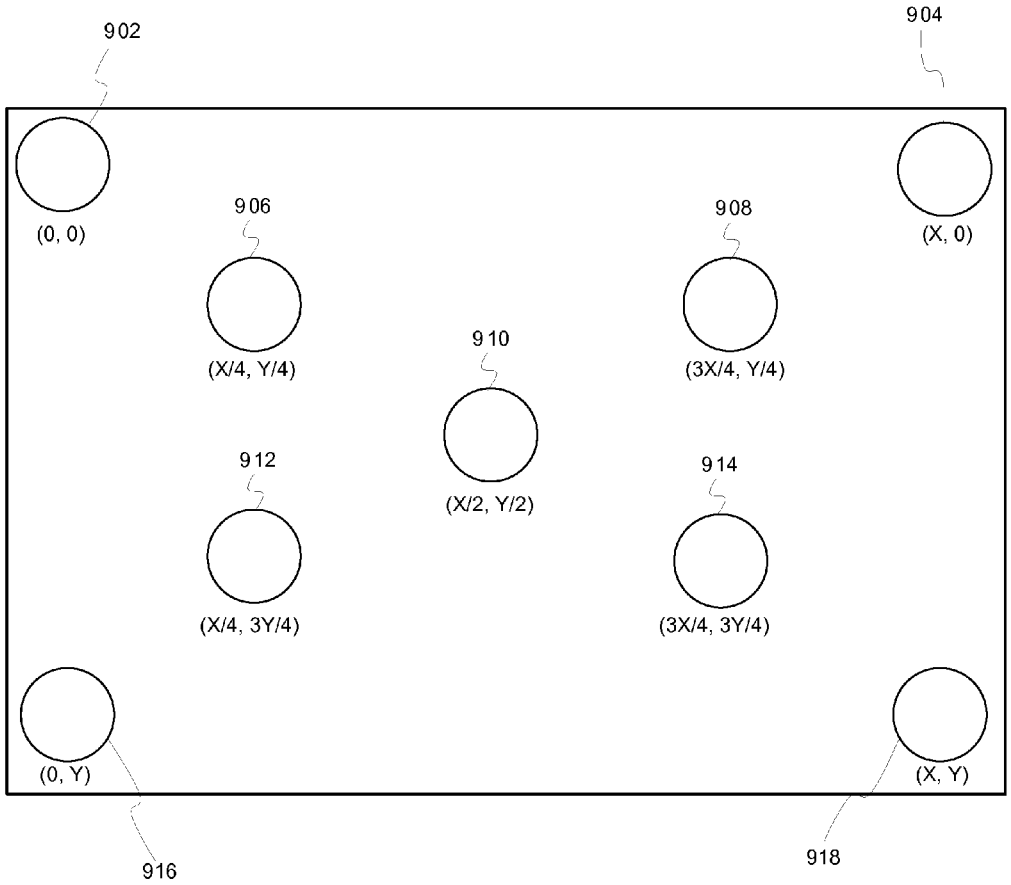
FIG. 9 is an example of a number of pixel locations (used for sequential multi-frame pixel encoding) within multiple frames for display on a display monitor of a wagering game machine, according to some example embodiments.
Figure 10:
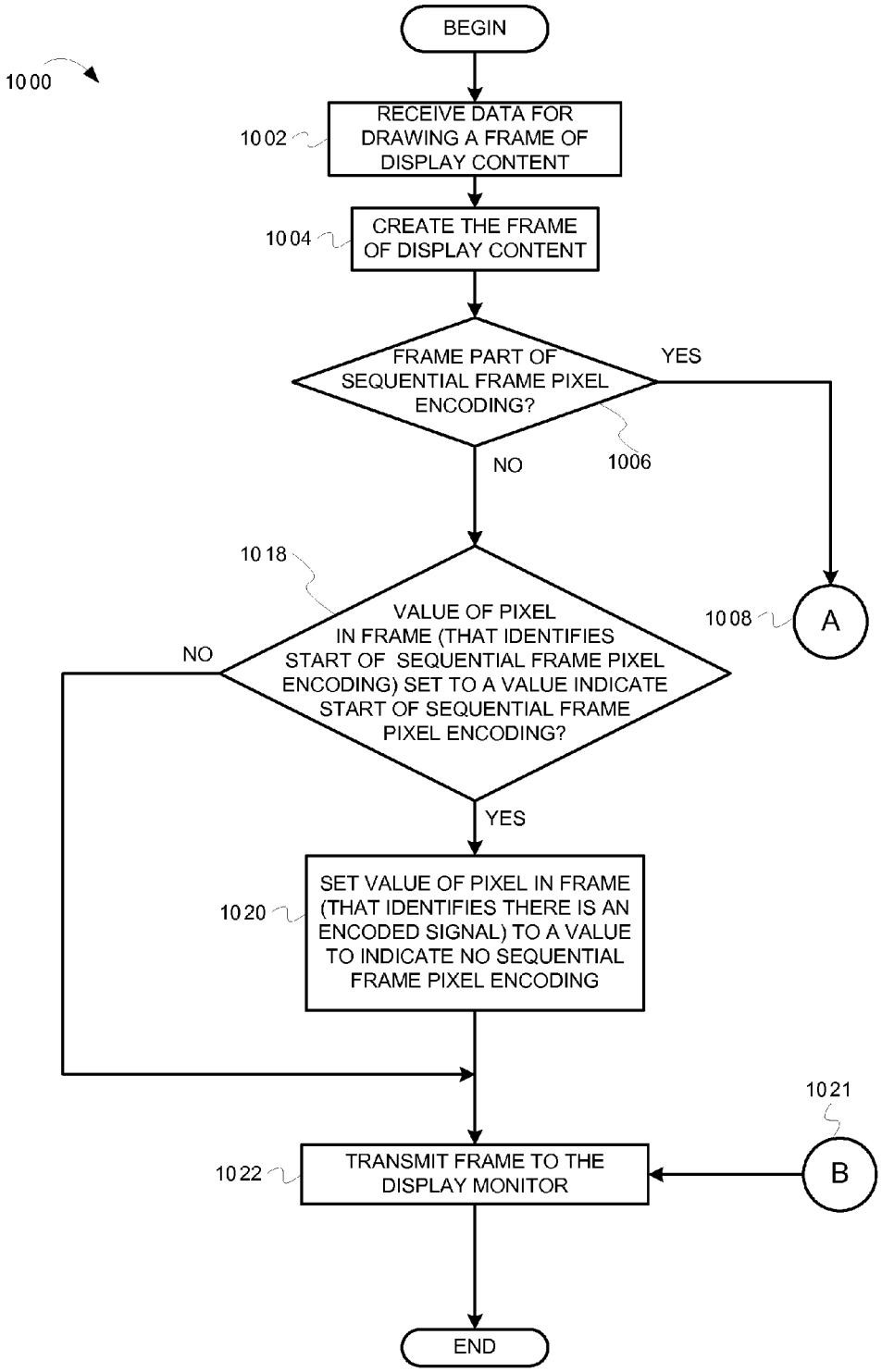
FIGS. 10-11 are flowcharts of operations for sequential multi-frame pixel encoding that is used to monitor display of third party content on a display monitor of a wagering game machine, according to some example embodiments.
Figure 11:
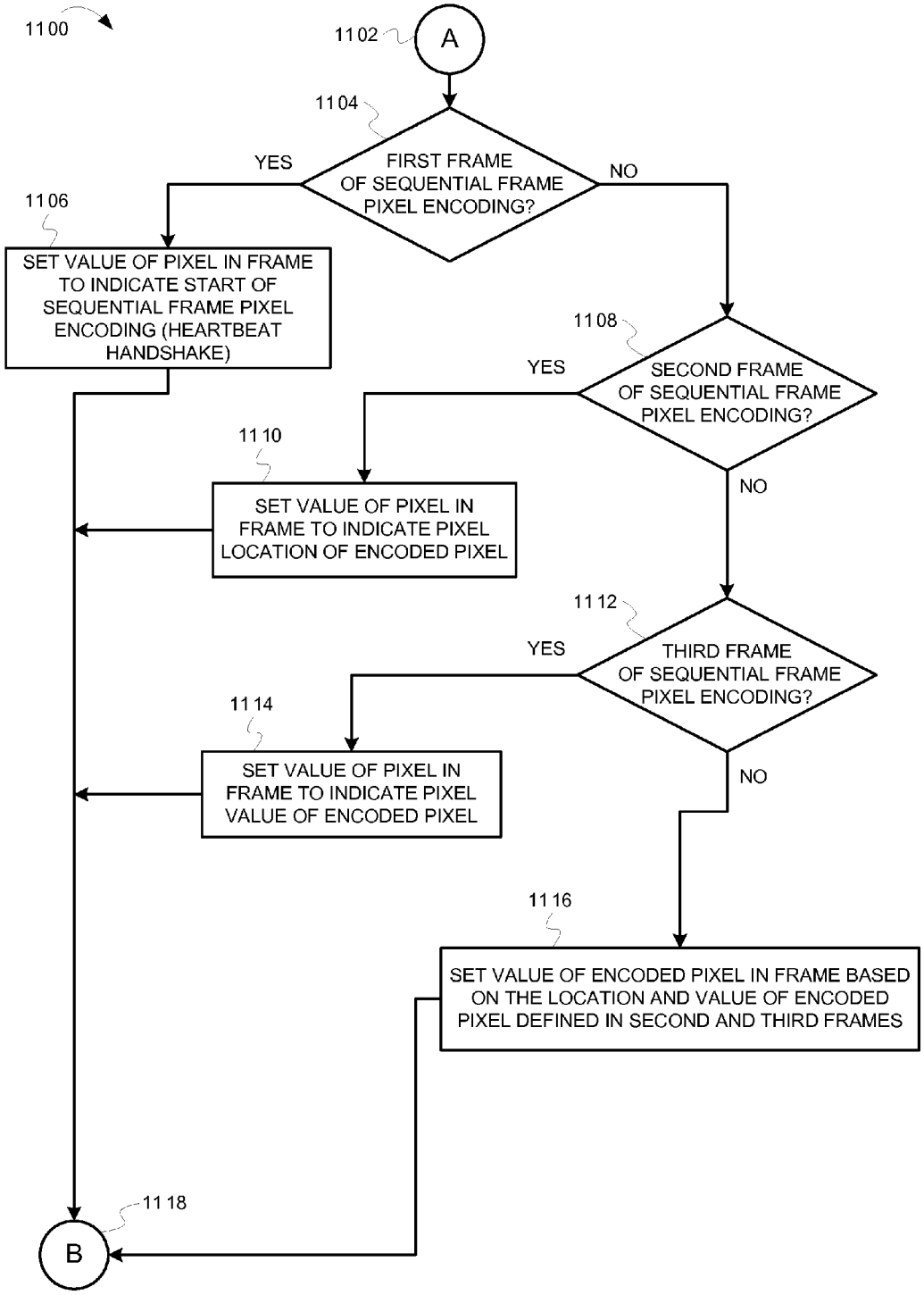
Figure 12:
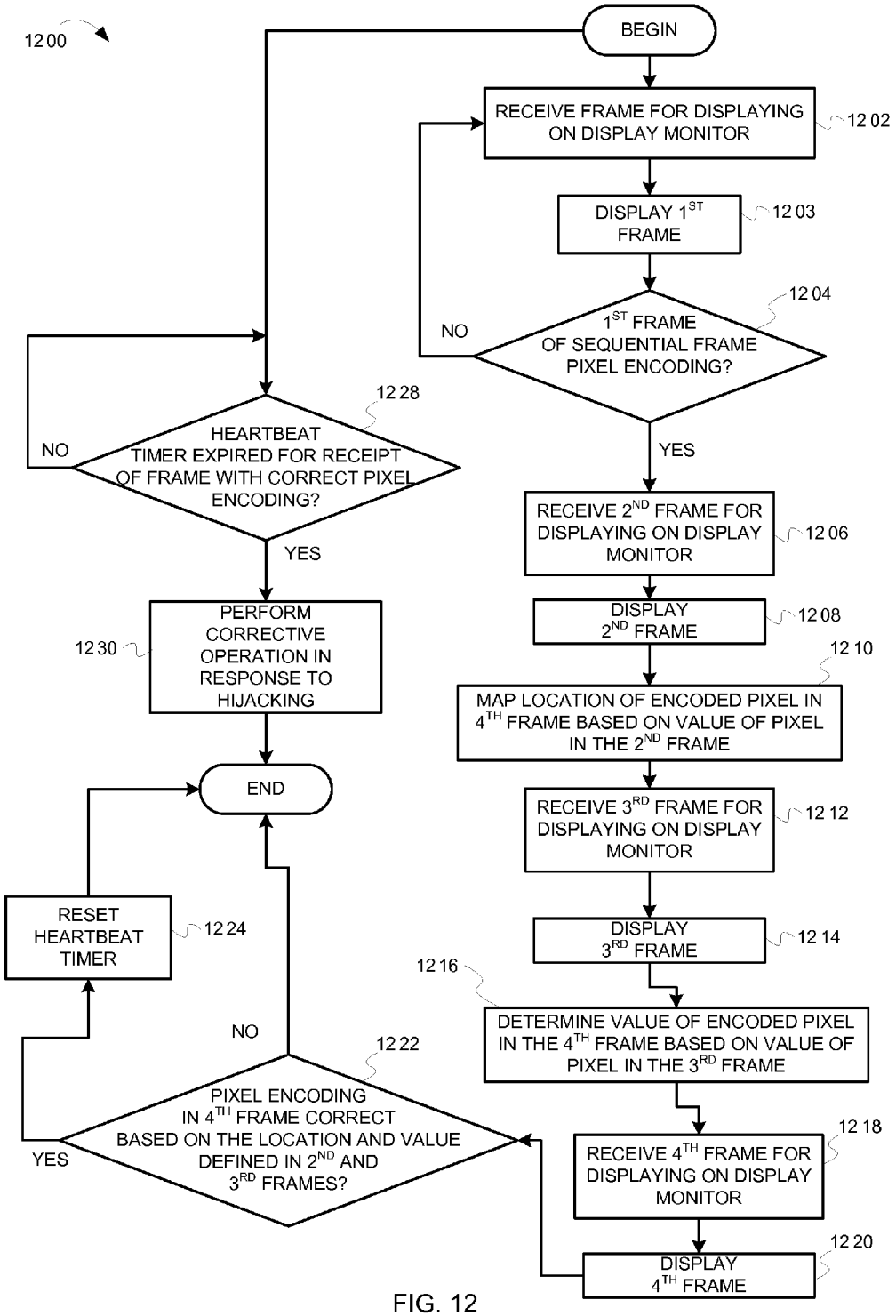
FIG. 12 is a flowchart of operations for monitoring display of third party content on a display monitor of a wagering game machine using multi-frame pixel encoding, according to some example embodiments.

Monitoring of Unauthorized Third Party Content Using Sequential Multi-Frame Pixel Encoding Another example embodiment for monitoring third party content on a display of a wagering game machine is now described. In particular, FIGS. 9-12 illustrate monitoring of third party content using sequential multi-frame pixel encoding, according to some example embodiments. FIG. 9 illustrates an example of pixel locations (used for sequential multi-frame pixel encoding) that are within multiple frames to be displayed on a display monitor of a wagering game machine. FIGS. 10-12 include flowcharts of operations for sequential multi-frame pixel encoding. While described such that the frames are sequential, in some other example embodiments, non-sequential frames can be used for the multi-frame pixel encoding.

FIG. 9 is an example of a number of pixel locations (used for sequential multi-frame pixel encoding) within multiple frames for display on a display monitor of a wagering game machine, according to some example embodiments. FIG. 9 includes 9 different pixel locations (pixels 902-918). The pixel locations are defined relative to the size or resolution of the frame. In particular, the pixel locations are defined in terms of (x,y), wherein x is the maximum width and y is the maximum height. The pixel 902 is the top left pixel in the frame—location (0,0). The pixel 904 is located at the top right pixel in the frame—location (x,0). The pixel 916 is the bottom left pixel in the frame—location (0,y). The pixel 918 is the bottom right pixel in the frame—location (x,y). The pixel 910 is the center pixel in the frame—location (x/2, y/2). The pixel 906 is at location (x/4, y/4). The pixel 908 is at location (3x/4, y/4). The pixel 912 is at location (x/4, 3y/4). The pixel 914 is at location (3x/4, 3y/4).

In some example embodiments, the wagering game module 110 produces pixels based on a coordinate system wherein the top left hand pixel position for (x,y) is (1,1), while the display 119 outputs the pixels based on a coordinate system wherein the top left hand pixel position for (x,y) is (0,0). Accordingly, the monitor module 116 can perform any suitable translation between the two coordinate systems. For example, the monitor module 116 can subtract from the pixel coordinates prior to display (e.g., $(x,y)\rightarrow(x-1, y-1)$). As further described below in the description of FIGS. 10-12, these pixel locations across multiple sequential frames are used to provide multi-frame pixel encoding to monitor unauthorized third party content.

FIGS. 10-11 are flowcharts of operations for sequential multi-frame pixel encoding that is used to monitor display of third party content on a display monitor of a wagering game machine, according to some example embodiments. In this example, operations of a flowchart 1000 and a flowchart 1100 are performed by the display output module 111 executing on the main processor 106 (see FIG. 1). The operations of the flowchart 1000 and the flowchart 1100 are performed together and are coupled together at points A and B (as further described below). The flowchart 1000 of FIG. 10 is described first. The operations of the flowchart 1000 begin at block 1002.

At block 1002, the display output module 111 receives data for drawing a frame of display content. For example, the display output module 111 may receive data for a result of a bonus event from wagering game play from the wagering game module 110. In another example, the display output module 111 can receive data for displaying a video that is part of the theme of wagering game machine, data for outputting a still image of a legal disclaimer, data for outputting video or still images that is part of the wagering game play, etc. The operations of the flowchart 1000 continue at block 1004.

At block 1004, the display output module 111 creates the frame of display content. The display output module 111 determines the number of pixels and their locations based on the resolution, size, etc. of the frame. The display output module 111 also sets the values for the pixels in the frame. The operations of the flowchart 1000 continue at block 1006.

At block 1006, the display output module 111 determines whether the current frame is one of four sequential frames that include pixel encoding. As further described below, the first frame in the four sequential frames includes a pixel value that defines whether this frame and the next three frames include pixel encoding. In some example embodiments, the sequential multi-frame pixel encoding occurs periodically (e.g., once per second). Therefore, if this is the first frame of the four sequential frames, the display output module 111 can determine based on whether the next periodic pixel encoding is to occur. If this is frame is one of the other three frames, the display output module 111 can make this determination based on this pixel value in the first frame. If the frame is part of the sequential frame pixel encoding, operations continue at continuation point 1008 (point A), which continues at continuation point 1102 (point A—FIG. 11, which is described in more detail below). If the frame is not part of the sequential frame pixel encoding, operations of the flowchart 1000 continue at block 1018.

At block 1018, the display output module 111 determines whether the value of the pixel in the frame (that identifies there is pixel encoding) is set to a value to indicate pixel encoding. A designated pixel having a particular value indicates that pixel encoding is within the frame. With reference to the example of FIG. 9, the pixel 902 at location (0,0) would set to a certain RGB value (e.g., (0,0,0)) to indicate the pixel encoding is occurring in this frame and through the next three sequential frames. Accordingly, the display output module 111 needs to ensure that this designated pixel has not been accidently set to this particular value as part of the creating of the frame (at block 1004). If the value of the pixel in the frame (that identifies there is pixel encoding) is set to a value to indicate pixel encoding, operations of the flowchart 700 continue at block 1020. Otherwise, operations of the flowchart 1000 continue at block 1022.

At block 1020, the display output module 111 sets the value of the pixel in the frame (that identifies there is pixel encoding) to a value to indicate no pixel encoding. In particular, the display output module 111 can set this value to any value but the particular value that indicates pixel encoding. If this check at block 1018 and setting at block 1020 is not done, the monitor module 116 at the display monitor 118 may receive a frame that does not include pixel encoding but process such frame (and the next three frames) as if there is pixel encoding. In particular, if this pixel is accidently set to indicate pixel encoding for a frame that does not include pixel encoding, the monitor module 116 may mark the frames as being changed by third party hardware (hijacking) Operations of the flowchart 1000 continue at block 1022.

At block 1022, the display output module 111 transmits the frame of display content to the display monitor 118. With reference to FIG. 1, the display output module 111 can transmit the frame of display content over the bus 130 to the video card 112 and over the bus 133 to the display monitor 118 (shown as the display content 132). The pixel encoding can be used in conjunction with other example embodiments described herein. For example, the display content 132 can be encrypted. Alternatively or in addition, the bus 133 can be an armored and/or epoxied cable. Alternatively on in addition, the operations of embedded images as described in reference to FIGS. 3-5 can also be performed. The operations of the flowchart 1000 and the flowchart 1100 down this decision block are complete.

The operations of the flowchart 1000 continue with the operations of the flowchart 1100 of FIG. 11. The operations of the flowchart 1100 begin at continuation point A 1102 (which is a continuation from the continuation point A 1008 of the flowchart 1000). The operations of the flowchart 1000 from the continuation point A 1102 continue at block 1104.

At block 1104, the display output module 111 determines whether this is the first frame of the sequential frame pixel encoding. In particular, this path of the flowcharts 1000 and 1100 is reached because a determination is made that a frame that is being created is to be one of the frames of a sequential multi-frame pixel encoding (see block 1006 of FIG. 10). In some example embodiments, the sequential multi-frame pixel encoding occurs periodically (e.g., once per second). Also, the display output module 111 determines whether this is the first of four frames in the sequential frame pixel encoding. If this frame is the first frame, the operations of the flowchart 1100 continue at block 1106. Otherwise, the operations of the flowchart 1100 continue at block 1108.

At block 1106, the display output module 111 sets the value of a particular pixel in the frame to indicate a start of sequential frame pixel encoding. With reference to FIG. 9 in some example embodiments, the pixel being set is the pixel 902 at location (0,0). If RGB pixel value of this pixel is set to (0,0,0), then this indicates a start of sequential frame pixel encoding. Accordingly, if the monitor module 116 in the display monitor 118 receives a frame wherein the pixel at location (0,0) has an RGB value of (0,0,0), then the monitor module 116 processes assumes that this frame and the next three frames are part of a sequential multi-frame pixel encoding (as further described below). The operations of the flowchart 1100 continue at continuation point B 1118, which continues at continuation point B 1021, wherein the frame is transmitted to the display monitor at block 1022 (as described above).

At block 1108, the display output module 111 determines whether this is the second frame of the sequential frame pixel encoding. Because this frame is part of a sequential multi-frame pixel encoding and this frame is not the first frame, the display output module 111 determines whether this frame is the next frame. If this frame is the second frame, the operations of the flowchart 1100 continue at block 1110. Otherwise, the operations of the flowchart 1100 continue at block 1112.

At block 1110, the display output module 111 sets the value of the pixel in the frame to indicate the pixel location of the encoded pixel. With reference to FIG. 9 in some example embodiments, the pixel being set is the pixel 902 at location (0,0). The RGB pixel value of this pixel at location (0,0,0) dictates the location of the encoded pixel in the fourth frame (as further described below). Accordingly, different RGB pixel values of this pixel in the second frame allow the location of the encoded pixel in the fourth frame to be at different locations. In an example application, the following table is used to correlate the RGB pixel value for this pixel in the second frame with the location of the encoded pixel in the fourth frame:

Table 1

| RGB Value set in pixel (0,0) in $2^{nd}$ Frame | Location of Encoded Pixel in the $4^{th}$ Frame |
|---|---|
| (255,0,85) | (x,0) |
| (255,0,170) | (x,y) |
| (255,0,255) | (0,y) |
| (255,85,0) | (x/2,y/2) |
| (255,170,0) | (x/4,y/4) |
| (255,255,0) | (3x/4,y/4) |
| (255,85,85) | (3x/4,3y/4) |
| (255,85,170) | (x/4,3y/4) |

As shown in this example, the RGB value set in pixel (0,0) has the following format: (255, a, b), wherein the variation of 'a' and 'b' dictate the location of the encoded pixel. For example, if 'a' is 0 and 'b' is 85, the location of the encoded pixel is (x,0). In some example embodiments, the display output module 111 randomly selects the RGB value, thereby randomly locating the location of the encoded pixel. The operations of the flowchart 1100 continue at continuation point B 1118, which continues at continuation point B 1021, wherein the frame is transmitted to the display monitor at block 1022 (as described above).

At block 1112, the display output module 111 determines whether this is the third frame of the sequential frame pixel encoding. Because this frame is part of a sequential multi-frame pixel encoding and this frame is not the first frame or second frame, the display output module 111 determines whether this frame is the next frame. If this frame is the third frame, the operations of the flowchart 1100 continue at block 1114. Otherwise, the operations of the flowchart 1100 continue at block 1116.

At block 1114, the display output module 111 sets the value of the pixel in the frame to indicate the pixel value of the encoded pixel. With reference to FIG. 9 in some example embodiments, the pixel being set is the pixel 902 at location (0,0). The RGB pixel value of this pixel at location (0,0,0) will be the same RGB value of the encoded pixel in the fourth frame (as further described below). The operations of the flowchart 1100 continue at continuation point B 1118, which continues at continuation point B 1021, wherein the frame is transmitted to the display monitor at block 1022 (as described above).

At block 1116, the display output module 111 sets the value of the encoded pixel in the frame based on the location and value of the encoded pixel defined in the second and third frames. In particular, because the frame is part of the sequential multi-frame pixel encoding (having four frames) and the frame is not one of the first three frames (see blocks 1104, 1108 and 1112), the display output module 111 assumes that this frame is the fourth frame in the sequential multi-frame pixel encoding. The fourth frame is where the encoded pixel is located (having a location defined by the second frame and a RGB value defined by the third frame, as described above). The operations of the flowchart 1100 continue at continuation point B 1118, which continues at continuation point B 1021, wherein the frame is transmitted to the display monitor at block 1022 (as described above).

The flowcharts 1000 and 1100 described operations for creating frames of a sequential multi-frame pixel encoding by the display output module 111. The operations for processing the frames by the monitor module 116 in the display monitor 118 are now described. In particular, FIG. 12 is a flowchart of operations for monitoring display of third party content on a display monitor of a wagering game machine using sequential multi-frame pixel encoding, according to some example embodiments. In this example, operations of a flowchart 1200 are performed by the monitor module 116 (see FIG. 1). The operations of the flowchart 1200 include two sets of operations that can operate independent of each other. The two sets of operations are relevant to the monitoring of third party content using sequential multi-frame pixel encoding and can affect each other relative to the heartbeat timer (further described below). A first set of operations (blocks 1202-1224) are to process individual frames to determine if and whether there is correct pixel encoding. A second set of operations (block 1228-1230) monitor a heartbeat timer to ensure that frames with correct pixel encoding are received within a defined time period. The first set of operations can commence upon receipt of a frame for displaying on the display monitor 118. The second set of operations can commence after the display monitor 118 is powered on or rebooted. The first set of operations begins at block 1202.

At block 1202, the monitor module 116 receives a frame of display content for displaying on the display monitor 118. With reference to FIG. 1, the monitor module 116 can receive the frame from the display output module 111 over the bus 130 and the bus 133 through the video card 112. The operations of the flowchart 1200 continue at block 1204.

At block 1203, the monitor module 116 displays the first frame on the display monitor 118. The operations of the flowchart 1200 continue at block 1204.

At block 1204, the monitor module 116 determines whether this frame is the first frame of a sequential multi-frame frame pixel encoding. With reference to FIG. 9 in some example embodiments, the pixel that indicates whether this is the first frame of the pixel encoding is the pixel 902 at location (0,0) —see description of block 1106 of FIG. 11 above. If RGB pixel value of this pixel is set to (0,0,0), then this indicates a start of sequential frame pixel encoding. Therefore, the monitor module 116 checks whether the pixel at this location as the value (0,0,0). If this frame is not the first frame, the operations of the flowchart 1200 continue at block 1205. Otherwise, the operations of the flowchart 1200 continue at block 1206.

At block 1206, the monitor module 116 receives the second frame of display content for displaying on the display monitor 118. With reference to FIG. 1, the monitor module 116 can receive the second frame from the display output module 111 over the bus 130 and the bus 133 through the video card 112. The operations of the flowchart 1200 continue at block 1208.

At block 1208, the monitor module 116 displays the second frame on the display monitor 118. The operations of the flowchart 1200 continue at block 1210.

At block 1210, the monitor module 116 maps the location of the encoded pixel within the fourth frame based on a value of the pixel in the second frame. With reference to FIG. 9 in some example embodiments, the pixel having the location is the pixel 902 at location (0,0) —see description of block 1110 of FIG. 11 above. The RGB pixel value of this pixel at location (0,0,0) dictates the location of the encoded pixel in the fourth frame (as further described below). Accordingly, different RGB pixel values of this pixel in the second frame allow the location of the encoded pixel in the fourth frame to be at different locations. See Table 1 above. The operations of the flowchart 1200 continue at block 1212.

At block 1212, the monitor module 116 receives the third frame of display content for displaying on the display monitor 118. With reference to FIG. 1, the monitor module 116 can receive the third frame from the display output module 111 over the bus 130 and the bus 133 through the video card 112. The operations of the flowchart 1200 continue at block 1214.

At block 1214, the monitor module 116 displays the third frame on the display monitor 118. The operations of the flowchart 1200 continue at block 1216.

At block 1216, the monitor module 116 determines the value of the encoded pixel in the fourth frame based on the value of a pixel in the third frame. With reference to FIG. 9 in some example embodiments, the pixel having the value is the pixel 902 at location (0,0) —see description of block 1114 of FIG. 11 above. The RGB pixel value of this pixel at location (0,0,0) will be the same RGB value of the encoded pixel in the fourth frame (as further described below). The operations continue at block 1218.

At block 1218, the monitor module 116 receives the fourth frame of display content for displaying on the display monitor 118. With reference to FIG. 1, the monitor module 116 can receive the fourth frame from the display output module 111 over the bus 130 and the bus 133 through the video card 112. The operations of the flowchart 1200 continue at block 1220.

At block 1220, the monitor module 116 displays the fourth frame on the display monitor 118. The operations of the flowchart 1200 continue at block 1222.

At block 1222, the monitor module 116 determines whether the pixel encoding in the fourth frame is correct based on the location defined in the second frame and the value defined in the third frame. In particular, the monitor module 116 retrieves the RGB value for the pixel at the location defined in the second frame (see description of block 1210 above). The monitor module 116 then compares this RGB value to the RGB value set in the third frame (see description of block 1216 above). If these values are equal the pixel encoding is correct. Otherwise, the pixel encoding has failed. If the pixel encoding is correct, the operations of the flowchart 1200 continue at block 1224. Otherwise, the operations of the flowchart 1200 along this path are complete.

At block 1224, the monitor module 116 resets a heartbeat timer. The heartbeat timer is a timer for tracking the amount of time that has expired since the correct pixel encoding has been received. Specifically, the timer is for tracking the amount of time that has expired since multiple frames having correct pixel encoding has been received. In this situation, the monitor module 116 did receive correct pixel encoding. Accordingly, the monitor module 116 resets the heartbeat timer. If the heartbeat timer expires, the monitor module 116 performs one or more corrective operations in response to hijacking. This monitoring of the heartbeat timer is discussed in the description of block 1228 (see description below). The operations of the flowchart 1200 along this path are complete.

At block 1228, the monitor module 116 determines whether the heartbeat timer has expired for receipt of frames with correct pixel encoding. The heartbeat timer can be set to any time value (e.g., 1 second, 5 seconds, 90 seconds, etc.). The heartbeat timer can then countdown to zero. The heartbeat timer expires after reaching a value of zero. Also, as noted above at block 1224, the heartbeat timer can be reset to its initial value (e.g., 1 second, 5 seconds, 90 seconds, etc.) to restart the countdown if the monitor module 116 receives frames with the correct pixel encoding. If the heartbeat timer has not expired, the operations remain at block 1228 where the monitor module 116 checks for expiration of the heartbeat timer. This check of the expiration can occur periodically (e.g., every 0.5 seconds, every 1 second, etc.). If the heartbeat timer has expired, the operations of the flowchart 1200 continue at block 1230.

At block 1230, the monitor module 116 performs one or more corrective operations in response to hijacking of the display content for the display monitor 118. For example, the monitor module 116 can shut down the wagering game machine 100, log the error in nonvolatile memory, generate an error that is transmitted over a network to a backend server, shut down the display monitor 118, etc. With reference to FIG. 1, these operations can occur when the monitor module 116 sends the hijacking notification 134 back to the display output module 111. The display output module 111 can perform some of these operations. Alternatively or in addition, the monitor module 115 can shut down the display monitor 118, independent of communication with the display output module 111. Accordingly as described, the monitor module 116 can perform one or more corrective operations in response to 1) N number of consecutive pixel encoding failures (see block 814) or 2) expiration of the heartbeat timer after not receiving a frame with correct pixel encoding. The operations of the flowchart 1200 along this path are complete.

Monitoring of Unauthorized Third Party Content Using Challenge-Response

Figure 13:
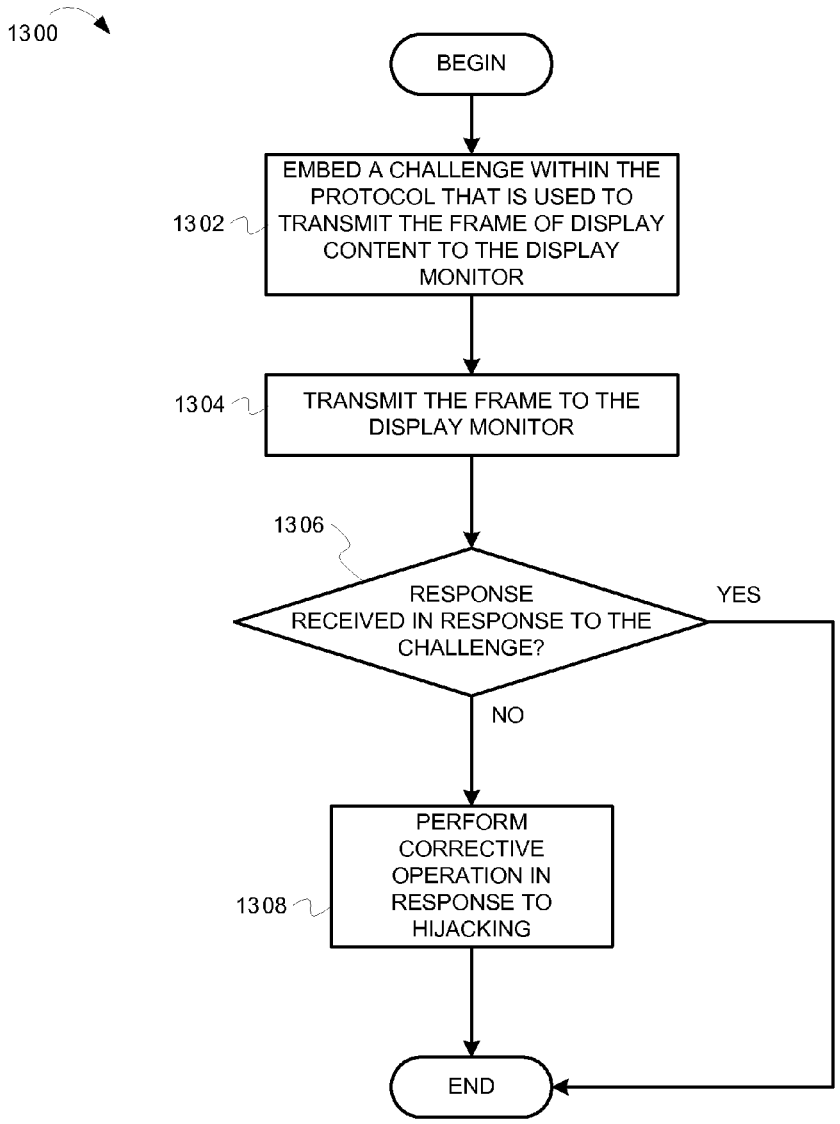
FIG. 13 is a flowchart for monitoring of third party content on a display monitor of a wagering game machine using challenge-response authentication, according to some example embodiments.

Another example embodiment for monitoring of third party content on a display of a wagering game machine is now described. In particular, FIG. 13 is a flowchart for monitoring of third party content on a display monitor of a wagering game machine using challenge-response authentication, according to some example embodiments. In this example, operations of a flowchart 1300 are performed by the display output module 111 executing on the main processor 106 (see FIG. 1). The operations of the flowchart 1300 begin at block 1302.

At block 1302, the display output module 111 embeds a challenge within the protocol that is used to transmit the frame of display content to the display monitor 118. Alternatively or in addition, the display output module 111 can embed the challenge within the image of the frame. For example, the display output module 111 can embed the challenge into one or more pixels (similar to the pixel encoding operations described above). The challenge can be any type of alphanumeric values, wherein the monitor module 116 of the display monitor 118 provides the proper response thereto. The operations of the flowchart 1300 continue at block 1304.

At block 1304, the display output module 111 transmits the frame of display content to the display monitor 118. With reference to FIG. 1, the display output module 111 can transmit the frame of display content over the bus 130 to the video card 112 and over the bus 133 to the display monitor 118 (shown as the display content 132). The challenge-response authentication can be used in conjunction with other example embodiments described herein. For example, the display content 132 can be encrypted. Alternatively or in addition, the bus 133 can be an armored and/or epoxied cable. Alternatively on in addition, the operations of the embedded images as described in reference to FIGS. 3-5 or the pixel encoding as described in reference to FIGS. 6-8 can also be performed. The operations of the flowchart 1300 continue at block 1306.

At block 1306, the display output module 111 determines whether the correct response has been received in response to the challenge that was transmitted. In some example embodiments, there is a single correct response to a given challenge. Upon receipt, the monitor module 116 can transmit back the correct response to the display output module 111. Therefore, this challenged-response authentication can identify the adding of the third party content to the display content in the frame. In particular, the third party hardware can alter or remove the challenge when adding the third party display content. Accordingly, the monitor module 116 may not receive the challenge or may receive the incorrect challenge because of the adding of the third party content. For example, the third part hardware can alter the protocol or display content that includes the challenge. If the correct response is received in response to the challenge, the operations of the flowchart 1300 are complete. Otherwise, the operations continue at block 1308.

At block 1308, the display output module 111 performs one or more corrective operations in response to hijacking of the display content for the display monitor 118. For example, the display output module 111 can shut down the wagering game machine 100, log the error in nonvolatile memory, generate an error that is transmitted over a network to a backend server, shut down the display monitor 118, etc. The operations of the flowchart 1300 are complete.

Monitoring of Display of Authorized Third Party Content

Operators of wagering game establishments that use these wagering game machines may want an option to allowed authorized third parties to change the display content. In particular, these operators may want to allow advertising by third parties in order to generate more revenue. Accordingly, some example embodiments do not prevent all changes by third parties. Rather, developers of the wagering game machine can manage access to the display content by authorized third parties. Accordingly, some example embodiments attempt to preclude unauthorized third parties to change the display content, while allowing authorized third parties to do so.

Some or all of a display can be used to display authorized third party content. The authorized third party content can be also provided to the wagering game machine 100 over a network. Alternatively or in addition, the third party content can be provided by a local upload through an input/output port of the wagering game machine. Also, the third party content can be embedded with an authorized watermark. In some example embodiments, the developers of the wagering game machine, the operators of a wagering game establishment that includes the wagering game machine and/or gaming regulators can add the authorized watermark to the third party content. In some example embodiments, the authorized watermarks can be dynamic. In particular, the authorized watermarks can be different across the different frames of display content. Accordingly, for a video, the authorized watermark can change a number of different frames of the video. Also, the location in the frame, the type of watermark, etc. can also change. In reference to FIG. 2, the watermarks can be viewable area of display 220 or the nonviewable area of display 222. The watermarks can also change depending on the time of day, the type of wagering game machine, the particular wagering game establishment, etc. With reference to FIG. 1, the display output module 111 can add the third party content when initially creating the frame of display content. Alternatively or in addition, third party hardware can be added to the wagering game machine 100. The third party hardware can then intercept the frame of display content and add its third party content to the frame.

These unique authorized watermarks help ensure that the appropriate content is being displayed for a given type of wagering game machine. For example, for a given wagering game machine, the monitoring ensures that a defined set of third party content is displayed. Such a configuration precludes third party content having an adult theme (e.g., an advertisement for hard liquor) from being displayed on wagering game machine having a family friendly theme.

Figure 14:
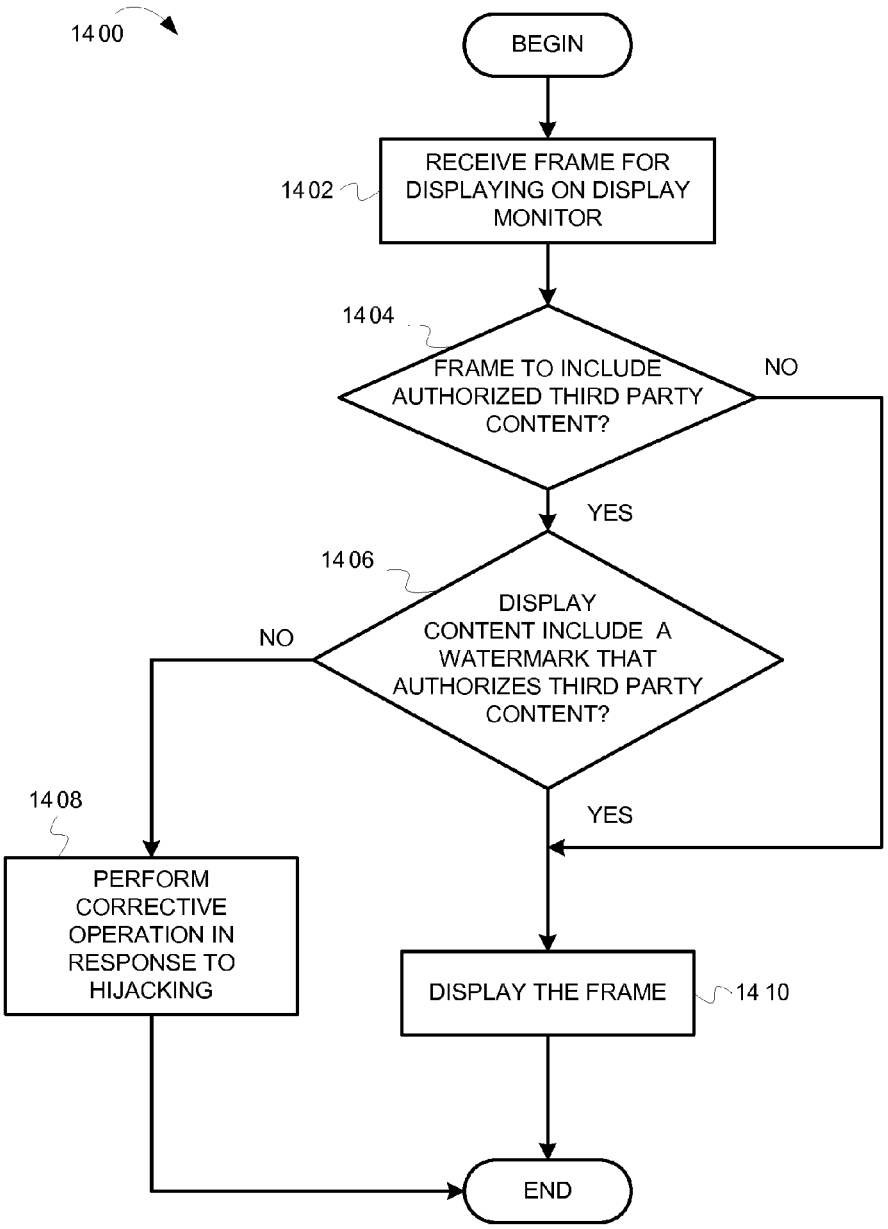
FIG. 14 is a flowchart for monitoring incorporation of authorized third party content on a display of a wagering game machine using watermarks, according to some example embodiments.

FIG. 14 is a flowchart for monitoring incorporation of authorized third party content on a display of a wagering game machine using watermarks, according to some example embodiments. In this example, the operations of a flowchart 1400 are performed by the monitor module 116. The operations of the flowchart 1400 begin at block 1402.

At block 1402, the monitor module 116 receives frame of display content for displaying on the display monitor 118. With reference to FIG. 1, the monitor module 116 can receive the frame from the display output module 111 over the bus 130 and the bus 133 through the video card 112. The operations of the flowchart 1400 continue at block 1404.

At block 1404, the monitor module 116 determines whether the frame is to include authorized third party content. This determination can be based on an agreement between the third parties and the developers of the wagering game machine 100 and/or the operators of the wagering game establishment. The agreement can determine which display, the particular authorized third party content, the time of day, etc. For example, the agreement can set forth that a given third party content can be displayed from 7-11 pm on Saturday and Sundays for a six month period. As described above, the display output module 111 can add the third party content. Alternatively or in addition, third party hardware can add the third party content. Regardless of the source of the third party content, the monitor module 116 checks its authorization (as described below). If the frame is not to include authorized third party content, the operations of the flowchart 1400 continue at block 1410. Otherwise, the operations continue at block 1406.

At block 1406, the monitor module 116 determines whether the display content includes a watermark that authorizes the incorporation of third party content. The monitor module 116 can determine if the particular watermark is at a given location in the frame that is to be displayed. For example, the monitor module 116 can determine if a unique watermark associated with an authorized third party content for a particular third party is located at a given location within the frame of display content. If the display content does not include the authorized watermark, the operations continue at block 1408. Otherwise, the operations continue at block 1410.

At block 1408, the monitor module 116 performs one or more corrective operations in response to hijacking of the display content for the display monitor 118. In particular, it is assumed that if the authorized watermark is not located in the third party content some unauthorized third party content has been added to the display content. In some example embodiments, some or all techniques for the monitoring of unauthorized third party content as described herein is performed prior to performing this corrective operation. For example, pixel encoding, embedded images, or challenge-response authentication is performed. If these techniques indicate hijacking by third party content, the monitor module 116 then performs the corrective operation. For example, the display output module 111 can shut down the wagering game machine 100, log the error in nonvolatile memory, generate an error that is transmitted over a network to a backend server, shut down the display monitor 118, etc. The operations of the flowchart 1400 are complete.

At block 1410, the monitor module 116 displays the frame on the display monitor 118. In some example embodiments, some or all techniques for the monitoring of unauthorized third party content as described herein is performed prior to displaying the frame. For example, pixel encoding, embedded images, or challenge-response authentication is performed prior to displaying the frame. The operations of the flowchart 1400 are then complete.

Multiple third parties can be authorized to change the display content on a given wagering game machine. In some example embodiments, the monitor module 116 can track the number of times a given third party content is displayed. For example, each third party can have a unique authorized watermark. Accordingly, the monitor module 116 can monitor the authorized watermarks provided in the display content that identifies the third party. The wagering game machine 100 can provide a logging of the third party content being displayed. The operators of the wagering game establishments can use this logging in their accounting for charging third parties for displaying of their third party content.

Wagering Game Machine Architectures

Figure 15:
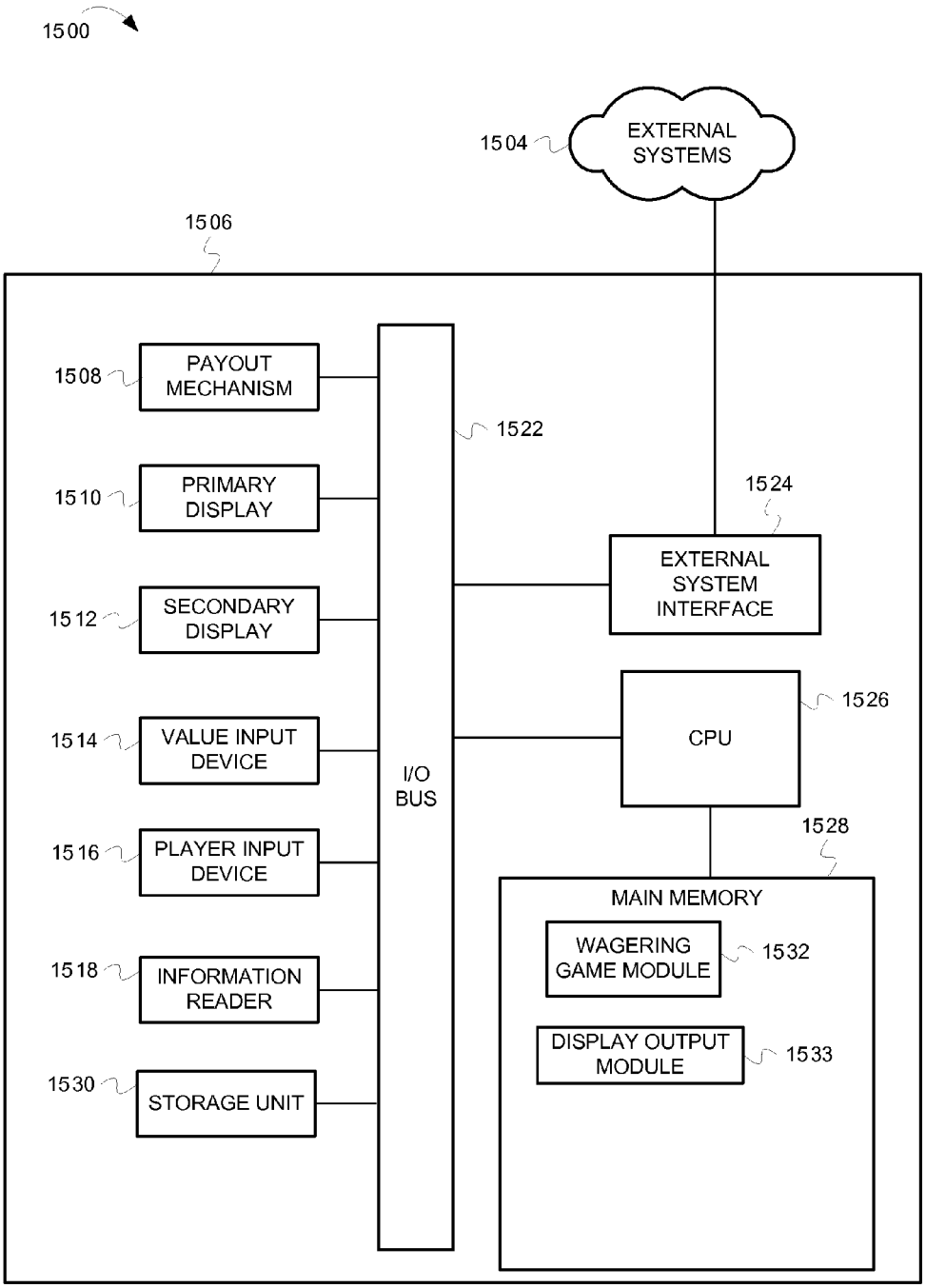
FIG. 15 is a block diagram illustrating a wagering game machine architecture, according to some example embodiments.

FIG. 15 is a block diagram illustrating a wagering game machine architecture, according to some example embodiments. As shown in FIG. 15, the wagering game machine architecture 1500 includes a wagering game machine 1506, which includes a central processing unit (CPU) 1526 connected to main memory 1528. The CPU 1526 can include any suitable processor, such as an Intel® Pentium processor, Intel® Core 2 Duo processor, AMD Opteron™ processor, or UltraSPARC processor. The main memory 1528 includes a wagering game module 1532 and a display output module 1533. In one embodiment, the wagering game module 1532 can present wagering games, such as video poker, video black jack, video slots, video lottery, etc., in whole or part.

The CPU 1526 is also connected to an input/output (I/O) bus 1522, which can include any suitable bus technologies, such as an AGTL+ frontside bus and a PCI backside bus. The I/O bus 1522 is connected to a payout mechanism 1508, primary display 1510, secondary display 1512, value input device 1514, player input device 1516, information reader 1518, and storage unit 1530. The player input device 1516 can include the value input device 1514 to the extent the player input device 1516 is used to place wagers. The I/O bus 1522 is also connected to an external system interface 1524, which is connected to external systems 1504 (e.g., wagering game networks).

In one embodiment, the wagering game machine 1506 can include additional peripheral devices and/or more than one of each component shown in FIG. 15. For example, in one embodiment, the wagering game machine 1506 can include multiple external system interfaces 1524 and/or multiple CPUs 1526. In one embodiment, any of the components can be integrated or subdivided.

Any component of the architecture 1500 can include hardware, firmware, and/or machine-readable storage media including instructions for performing the operations described herein. Machine-readable storage media includes any device that provides (i.e., stores and/or transmits) information in a form readable by a machine (e.g., a wagering game machine, computer, etc.). For example, machine-readable storage media includes read only memory (ROM), random access memory (RAM), magnetic disk storage media, optical storage media, flash memory machines, etc.

Example Wagering Game Machine

Figure 16:
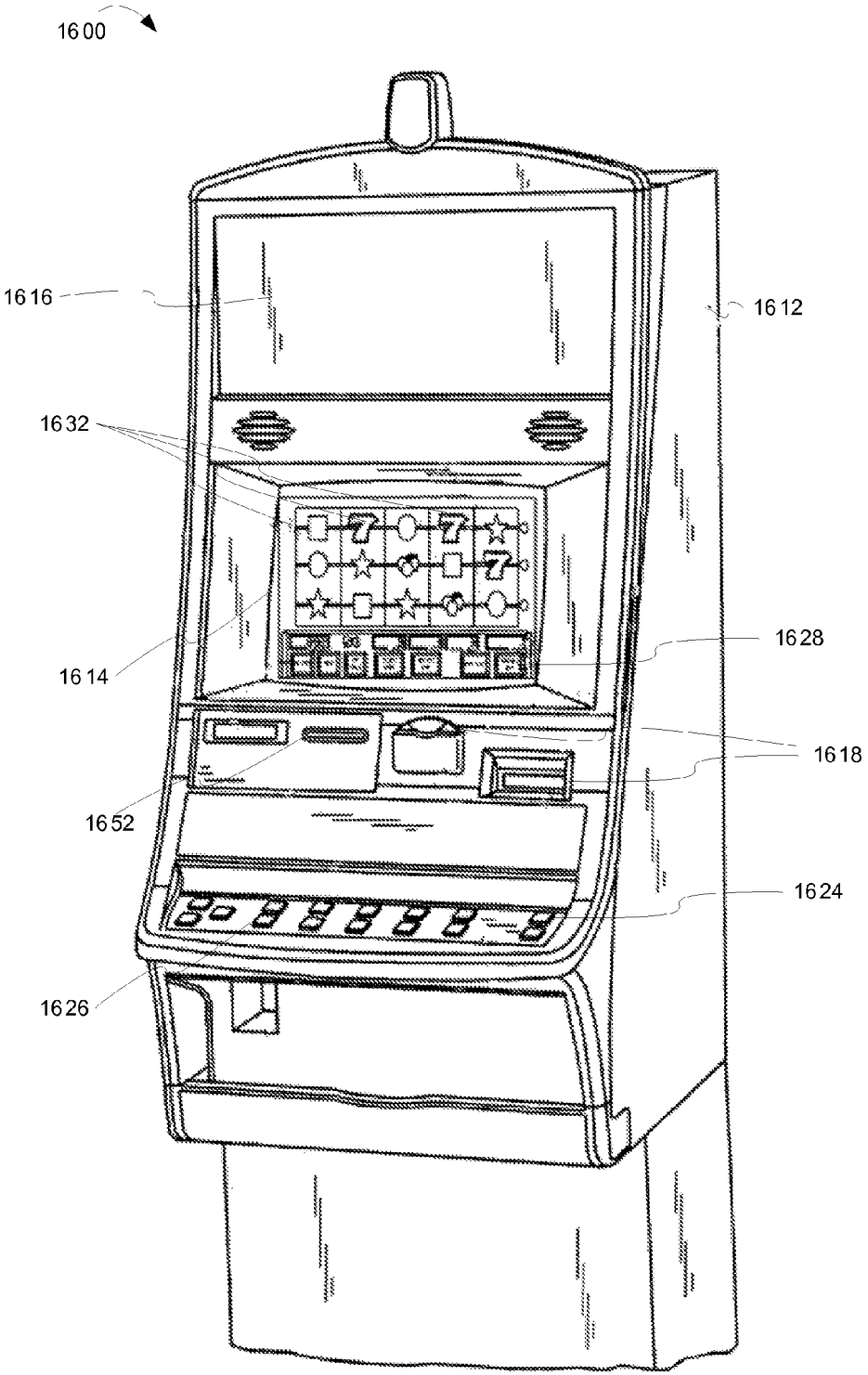
FIG. 16 is a perspective view of a wagering game machine, according to some example embodiments.

FIG. 16 is a perspective view of a wagering game machine, according to some example embodiments. Referring to FIG.

16, a wagering game machine 1600 is used in gaming establishments, such as casinos. According to embodiments, the wagering game machine 1600 can be any type of wagering game machine and can have varying structures and methods of operation. For example, the wagering game machine 1600 can be an electromechanical wagering game machine configured to play mechanical slots, or it can be an electronic wagering game machine configured to play video casino games, such as blackjack, slots, keno, poker, blackjack, roulette, etc.

The wagering game machine 1600 comprises a housing 1612 and includes input devices, including value input devices 1618 and a player input device 1624. For output, the wagering game machine 1600 includes a primary display 1614 for displaying information about a basic wagering game. The primary display 1614 can also display information about a bonus wagering game and a progressive wagering game. The wagering game machine 1600 also includes a secondary display 1616 for displaying wagering game events, wagering game outcomes, and/or signage information. While some components of the wagering game machine 1600 are described herein, numerous other elements can exist and can be used in any number or combination to create varying forms of the wagering game machine 1600.

The value input devices 1618 can take any suitable form and can be located on the front of the housing 1612. The value input devices 1618 can receive currency and/or credits inserted by a player. The value input devices 1618 can include coin acceptors for receiving coin currency and bill acceptors for receiving paper currency. Furthermore, the value input devices 1618 can include ticket readers or barcode scanners for reading information stored on vouchers, cards, or other tangible portable storage devices. The vouchers or cards can authorize access to central accounts, which can transfer money to the wagering game machine 1600.

The player input device 1624 comprises a plurality of push buttons on a button panel 1626 for operating the wagering game machine 1600. In addition, or alternatively, the player input device 1624 can comprise a touch screen 1628 mounted over the primary display 1614 and/or secondary display 1616.

The various components of the wagering game machine 1600 can be connected directly to, or contained within, the housing 1612. Alternatively, some of the wagering game machine's components can be located outside of the housing 1612, while being communicatively coupled with the wagering game machine 1600 using any suitable wired or wireless communication technology.

The operation of the basic wagering game can be displayed to the player on the primary display 1614. The primary display 1614 can also display a bonus game associated with the basic wagering game. The primary display 1614 can include a cathode ray tube (CRT), a high resolution liquid crystal display (LCD), a plasma display, light emitting diodes (LEDs), or any other type of display suitable for use in the wagering game machine 1600. Alternatively, the primary display 1614 can include a number of mechanical reels to display the outcome. In FIG. 16, the wagering game machine 1600 is an "upright" version in which the primary display 1614 is oriented vertically relative to the player. Alternatively, the wagering game machine can be a "slant-top" version in which the primary display 1614 is slanted at about a thirty-degree angle toward the player of the wagering game machine 1600. In yet another embodiment, the wagering game machine 1600 can exhibit any suitable form factor, such as a free standing model, bartop model, mobile handheld model, or workstation console model.

A player begins playing a basic wagering game by making a wager via the value input device 1618. The player can initiate play by using the player input device's buttons or touch screen 1628. The basic game can include arranging a plurality of symbols along a payline 1632, which indicates one or more outcomes of the basic game. Such outcomes can be randomly selected in response to player input. At least one of the outcomes, which can include any variation or combination of symbols, can trigger a bonus game.

In some embodiments, the wagering game machine 1600 can also include an information reader 1652, which can include a card reader, ticket reader, bar code scanner, RFID transceiver, or computer readable storage medium interface. In some embodiments, the information reader 1652 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computerized method comprising:

creating image frames for presentation on a monitor of a wagering game machine;

performing, by a processor, pixel encoding in the image frames, wherein the pixel encoding comprises setting a value of at least one pixel in each of the image frames, wherein the value can be validated as remaining unchanged after the creating of the image frames and before presentation of the image frames on the monitor of the wagering game machine, wherein a validation of the pixel encoding is for determining at least one of, that third party content has been added to the image frames and that one or more of the image frames has been replaced with third party images;

validating the value in each of the image frames, wherein the validating indicates that one or more of the image frames has been changed;

determining that the third party content has been added to the image frames based on decoding of the pixel encoding;

precluding wagering game play on the wagering machine, in response to determining that the third party content has been added to the image frames; and transmitting the image frames for presentation on the monitor of the wagering game machine.

2. The computerized method of claim 1, wherein the at least one pixel comprises a first pixel, a second pixel, a third pixel and a fourth pixel, wherein performing pixel encoding comprises:

setting a value of a first pixel to indicate that a second pixel is encoded;

setting a value of the second pixel to an encoded value;

setting a value of a third pixel to a value of an X coordinate of an X,Y position of the second pixel;

setting a value of a fourth pixel to a value of an Y coordinate of the X,Y position of the second pixel; and setting a value of a fifth pixel to a value equal to the encoded value.

3. The computerized method of claim 1, wherein creating the image and performing the pixel encoding occurs within a main processor on a carrier board in the wagering game machine, wherein the main processor and the monitor are communicatively coupled together through a bus, wherein the computerized method further comprises:

encrypting the image frames prior to transmitting the image frames to the monitor of the wagering game machine.

4. The computerized method of claim 3, wherein the encrypting of the image frames comprises encrypting using a High Bandwidth Digital Content Protection.

5. One or more non-transitory machine-readable storage media including instructions which, when executed by one or more processors, cause the one or more processors to perform operations comprising:

receiving an image frame for presentation on a monitor of a wagering game machine, wherein the image frame includes a pixel encoding;

decoding the pixel encoding in the image frame, wherein the pixel encoding comprises setting a value of at least one pixel in the images, wherein the decoding of the pixel encoding comprises validating that the value of the at least one pixel in the image frame remains unchanged after creating the image frame and before presentation of the image frame on the monitor of the wagering game machine;

determining that third party content has been added to the image frame based on the decoding of the pixel encoding; and performing a corrective operation, in response to determining that the third party content has been added to the image frame, wherein the corrective operation comprises precluding presentation of the image frame on the monitor of the wagering game machine.

6. The one or more non-transitory machine-readable storage media of claim 5, wherein the corrective operation comprises:

precluding wagering game play on the wagering machine.

7. The one or more non-transitory machine-readable storage media of claim 5, wherein the at least one pixel comprises a first pixel, a second pixel, a third pixel and a fourth pixel, wherein decoding the pixel encoding comprises:

retrieving a value of a first pixel in the image that comprises an X coordinate of an X,Y position of an encoded pixel;

retrieving a value of a second pixel in the image that comprises a Y coordinate of the X,Y position of the encoded pixel;

retrieving a value of the encoded pixel in the image from the X,Y position;

retrieving a value of a third pixel in the image that equals what the value of the encoded pixel should be;

comparing the value of the encoded pixel to the value of the third pixel;

responsive to determining that the value of the encoded pixel is not equal to the value of the third pixel, determining that the third party content has been added to the image of the image frame.

8. The one or more non-transitory machine-readable storage media of claim 5, further comprising receiving a number of image frames for presentation on the monitor of the wagering game machine, wherein at least a subset of the number of image frames include pixel encoding, the subset comprising the image frame, wherein the subset of the number of image frames having the pixel encoding are randomly selected from among the number of image frames.

9. The one or more non-transitory machine-readable storage media of claim 5, further comprising:

receiving a number of image frames for presentation on the monitor of the wagering game machine, wherein at least a subset of the number of image frames include pixel encoding, the subset comprising the image frame of the image; and performing the corrective operation, in response to not receiving at least one of the subset of the number of image frames within a defined time period.

10. A wagering game machine comprising:

a processor;

a wagering game module, executable on the processor, configured to present a wagering game on which monetary value can be wagered to a wagering game player;

a display output module, executable on the processor, configured to generate an image frame, wherein the image frame includes pixel encoding;

a display monitor having a monitor module that is communicatively coupled to the processor through a cable, wherein the monitor module is configured to, receive an image frame for presentation on the display monitor of the wagering game machine, wherein the image frame includes the pixel encoding;

decode the pixel encoding in the image frame, wherein the pixel encoding comprises setting a value of at least one pixel in the images, wherein the decode of the pixel encoding comprises validation that the value of the at least one pixel in the image frame remains unchanged after creating the image frame and before presentation of the image frame on the display monitor of the wagering game machine;

determine that third party content has been added to the image frame based on the decoding of the pixel encoding; and perform a corrective operation, in response to determining that the third party content has been added to the image frame, wherein the corrective operation comprises preclude wagering game play on the wagering game machine.

11. The wagering game machine of claim 10, wherein the corrective operation comprises preclude displaying on the display monitor of the wagering game machine.

12. The wagering game machine of claim 10, wherein the at least one pixel comprises a first pixel, a second pixel, a third pixel and a fourth pixel, wherein the monitor module is configured to perform the following as part of the decode of the pixel encoding:

retrieve a value of a first pixel in the image that comprises an X coordinate of an X,Y position of an encoded pixel;

retrieve a value of a second pixel in the image that comprises a Y coordinate of the X,Y position of the encoded pixel;

retrieve a value of the encoded pixel from the X,Y position;

retrieve a value of a third pixel in the image that equals what the value of the encoded pixel should be;

compare the value of the encoded pixel to the value of the third pixel;

responsive to determining that the value of the encoded pixel is not equal to the value of the third pixel, determine that the third party content has been added to the image of the image frame.

13. The wagering game machine of claim 10, wherein the display output module is configured to generate a number of image frames, wherein at least a subset of the number of image frames include pixel encoding, the subset comprising the image frame, wherein the subset of the number of image frames having the pixel encoding are randomly selected from among the number of image frames, and wherein the monitor module is configured to receive the number of image frames from the display output module through the cable.

14. The wagering game machine of claim 10, wherein the display output module is configured to generate a number of image frames, wherein at least a subset of the number of image frames include pixel encoding, the subset comprising the image frame, wherein the monitor module is configured to perform the corrective operation, in response to not receiving at least one of the subset of the number of image frames within a defined time period.

15. An apparatus comprising:

means for creating image frames for presentation on a monitor of a wagering game machine;

means for performing pixel encoding in the image frames, wherein the pixel encoding comprises setting a value of at least one pixel in each of the image frames, wherein the value can be validated as remaining unchanged after the creating of the image frames and before presentation of the image frames on the monitor of the wagering game machine, wherein a validation of the pixel encoding is for determining at least one of, that third party content has been added to the image frames and that one or more of the image frames has been replaced with third party images;

means for validating the value in each of the image frames, wherein the means for validating indicates that one or more of the image frames has been changed;

means for determining that the third party content has been added to the image frames based on decoding of the pixel encoding;

means for precluding wagering game play on the wagering machine, in response to determining that the third party content has been added to the image frames; and means for transmitting the image frames for presentation on the monitor of the wagering game machine.

16. The apparatus of claim 15, wherein the at least one pixel comprises a first pixel, a second pixel, a third pixel and a fourth pixel, wherein the means for performing the pixel encoding comprises:

means for setting a value of a first pixel to indicate that a second pixel is encoded;

means for setting a value of the second pixel to an encoded value;

means for setting a value of a third pixel to a value of an X coordinate of an X,Y position of the second pixel;

means for setting a value of a fourth pixel to a value of an Y coordinate of the X,Y position of the second pixel; and means for setting a value of a fifth pixel to a value equal to the encoded value.

17. The apparatus of claim 15, further comprising means for encrypting the image frames prior to transmitting the image frames to the monitor of the wagering game machine.

* * * * *